US011437756B2

(12) United States Patent
Shinmi et al.

(10) Patent No.: US 11,437,756 B2
(45) Date of Patent: Sep. 6, 2022

(54) CONNECTOR

(71) Applicant: YAZAKI CORPORATION, Tokyo (JP)

(72) Inventors: Yoshifumi Shinmi, Makinohara (JP); Kengo Machida, Kakegawa (JP); Masaya Okamoto, Kakegawa (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/185,956

(22) Filed: Feb. 25, 2021

(65) Prior Publication Data

US 2021/0273376 A1 Sep. 2, 2021

(30) Foreign Application Priority Data

Feb. 28, 2020 (JP) ..... JP2020-032785

(51) Int. Cl.

| | |
|---|---|
| ***H01R 13/62*** | (2006.01) |
| ***H01R 13/629*** | (2006.01) |
| ***H01R 13/71*** | (2006.01) |
| *H01R 13/52* | (2006.01) |

(52) U.S. Cl.

CPC ..... *H01R 13/62938* (2013.01); *H01R 13/71* (2013.01); *H01R 13/5202* (2013.01); *H01R 2201/26* (2013.01)

(58) Field of Classification Search

CPC ..... H01R 13/62933; H01R 13/62938; H01R 13/71; H01R 13/5202; H01R 2201/26

See application file for complete search history.

(56) References Cited

U.S. PATENT DOCUMENTS 5,230,635 A * 7/1993 Takenouchi ..... H01R 13/62938 439/153
5,257,942 A * 11/1993 Taguchi ..... H01R 13/62938 439/153
5,322,383 A * 6/1994 Saito ..... H01R 13/62938 403/321
5,562,465 A * 10/1996 Taguchi ..... H01R 13/62933 439/157
5,603,624 A * 2/1997 Taguchi ..... H01R 13/62933 439/372
5,611,702 A * 3/1997 Okamoto ..... H01R 13/62933 439/157

(Continued)

FOREIGN PATENT DOCUMENTS

JP 2013-48046 A 3/2013

*Primary Examiner* — Thanh Tam T Le
(74) *Attorney, Agent, or Firm* — Kenealy Vaidya LLP

(57) ABSTRACT

A connector includes: a first connector including a first main terminal; a second connector including a second main terminal and a boss having a protruding shape; and a fitting detection circuit configured to detect fitting of the first connector and the second connector. The first connector further includes a rotatable lever used for a fitting operation to the second connector and a fitting disengagement operation from the second connector. The lever includes a lock configured to lock, when the lock contacts the boss in the fitting disengagement operation, a rotation of the lever in a state where the fitting is not detected by the fitting detection circuit and also in a state where the first main terminal and the second main terminal are connected.

5 Claims, 18 Drawing Sheets

(56) References Cited

U.S. PATENT DOCUMENTS 5,637,003 A * 6/1997 Takahashi ..... H01R 13/62933 439/153
5,676,556 A * 10/1997 Yamaguchi ..... H01R 13/62933 439/157
6,142,787 A * 11/2000 Ikesugi ..... H01R 13/62933 439/372
6,319,050 B1 * 11/2001 Miyazaki ..... H01R 13/62938 439/157
6,488,516 B2 * 12/2002 Osawa ..... H01R 13/62938 439/157
6,695,631 B2 * 2/2004 Hamai ..... H01R 13/62938 439/372
6,705,881 B2 * 3/2004 Tsuchiya ..... H01R 13/62938 439/157
7,201,591 B2 * 4/2007 Fujii ..... H01R 13/639 439/157
7,258,557 B2 * 8/2007 Matsubara ..... H01R 13/62955 439/372
7,402,071 B2 * 7/2008 Ohtaka ..... H01R 13/641 439/357
7,445,491 B2 * 11/2008 Fujii ..... H01R 13/62938 439/157
7,918,676 B2 * 4/2011 Tonosaki ..... H01R 13/7031 439/157
9,385,473 B2 * 7/2016 Iwatani ..... H01R 13/641
9,413,108 B2 * 8/2016 Iwatani ..... H01R 13/62938
9,979,126 B2 * 5/2018 Takamura ..... H01R 13/62933
10,079,446 B1 * 9/2018 Sundarakrishnamachari ..... H01R 13/4364
10,109,954 B2 * 10/2018 Shimizu ..... H01R 13/62938
10,439,325 B2 * 10/2019 Kritter ..... H01R 13/62966
10,651,595 B2 * 5/2020 Yamane ..... H01R 13/506
10,763,610 B2 * 9/2020 Bae ..... H01R 13/62938
2019/0081438 A1 3/2019 Yamane et al.

* cited by examiner

CONNECTOR

CROSS-REFERENCE TO RELATED APPLICATIONS

This application claims priority of Japanese Patent Application No. 2020-032785 filed on Feb. 28, 2020, the entire contents of which are incorporated herein by reference.

FIELD

One or more embodiments of the present invention relate to a connector including a lever used for a fitting operation and a fitting disengagement operation of a first connector and a second connector, and further including a fitting detection circuit configured to detect fitting of the first connector and the second connector.

BACKGROUND

JP-A-2013-048046 discloses a connector in which, in order to fit a first connector (female connector) and a second connector (male connector) to each other, in response to rotation of a lever provided in the first connector, the first connector is pushed toward the second connector by an action of a boss groove of the lever and a boss of the second connector and then the connector is in a fitted state.

SUMMARY

Since the above-described connector includes the lever, the connector can serve as a low insertion force (LIF) connector capable of fitting the first connector and the second connector to each other with a low insertion force by applying a principle of leverage. The inventors of the present application consider that it is desired to provide a fitting detection circuit for such a connector. The fitting detection circuit forms a so-called interlock circuit capable of prohibiting conduction of the first connector and the second connector in a state where the first connector and the second connector are not completely fitted to each other. In a case where the connector is provided on a high-voltage circuit, the fitting detection circuit is an effective circuit for ensuring safety of an operator particularly when the fitting disengagement operation is performed.

At this point, it is considered that a better connector is obtained if it is possible to grasp a rotation position of the lever when the fitting detection circuit is in an off state (a state in which the fitting is not detected) in the fitting disengagement operation. From this, the inventors of the present application consider that it is necessary to consider making the fitting disengagement operation into two actions including an action until the fitting detection circuit is in an off state and an action after that. However, although a following description will be made with reference to FIGS. 18A to 18C, there is a problem in that a smooth operation cannot be performed even if the two actions are performed because the operator has to change hands.

In FIGS. 18A to 18C, a first connector 1 includes a housing 2 and a lever 3 rotatably provided in the housing 2. An illustration of the second connector, which is a counterpart of the first connector 1, is omitted. A flexible locking arm 5 is formed on a side portion 4 of the housing 2. The lever 3 includes a pair of arm plates 6 and a connecting portion 7 connecting the arm plates 6 to each other, and is formed in an illustrated shape. The arm plate 6 is formed with a groove-shaped boss groove 8 which is movably engaged with a boss having a protruding shape provided on the second connector (not shown). An operation portion 9 is formed in the connecting portion 7. A locked portion 10 is also formed in the connecting portion 7. A reference sign 11 in the drawings denotes a rotation shaft portion. The lever 3 is rotatable about the rotation shaft portion 11.

FIG. 18A shows a state of the first connector 1 when the first connector 1 and the second connector (not shown) are fitted to each other. First, when the fitting disengagement operation is started from this state, the lever 3 is rotationally moved to a position shown in FIG. 18B (first action). At this time, the locked portion 10 is caught by a claw portion of the flexible locking arm 5. In an inside of the first connector 1, a fitting detection circuit (not shown) is in an off state. Next, in a second action, the operator temporarily releases a hand from the operation portion 9 of the lever 3 to directly release the catch between the locked portion 10 and the flexible locking arm 5 by the hand, and then rotates the lever 3 to a position shown in FIG. 18C. Accordingly, the first connector 1 can be disengaged from the second connector (not shown). From the above operation, it can be understood that the operator has to change hands. As a result, there is a problem that a smooth operation cannot be performed in the two actions in a case of a structure as shown in FIGS. 18A to 18C.

One or more embodiments of the present invention have been made in view of the above circumstances, and an object of thereof is to provide a connector capable of making a fitting disengagement operation into two actions and smoothly performing the operation.

One or more embodiments of the present invention provide a connector including: a first connector including a first main terminal; a second connector including a second main terminal and a boss having a protruding shape; and a fitting detection circuit configured to detect fitting of the first connector and the second connector, wherein the first connector further includes a rotatable lever used for a fitting operation to the second connector and a fitting disengagement operation from the second connector, and wherein the lever includes a lock configured to lock, when the lock contacts the boss in the fitting disengagement operation, a rotation of the lever in a state where the fitting is not detected by the fitting detection circuit and also in a state where the first main terminal and the second main terminal are connected.

According to a connector of the present invention, a fitting disengagement operation can be made into two actions and the operation can be performed smoothly.

BRIEF DESCRIPTION OF DRAWINGS

FIGS. 6A and 6B are views of a lever, in which FIG. 6A is a side view, and FIG. 6B is an enlarged view of main parts.

FIGS. 7A to 7C are views at the start of a fitting operation, in which FIG. 7A is a state view of the connector, FIG. 7B is an enlarged view of main parts of FIG. 7A, and FIG. 7C is a view of a fitting detection circuit at a sectional position taken along a line A-A of FIG. 3.

FIGS. 8A to 8C are views when the fitting operation is completed, in which FIG. 8A is a state view of the connector, FIG. 8B is an enlarged view of main parts of FIG. 8A, and FIG. 8C is a view of the fitting detection circuit.

FIGS. 9A to 9C are views when a lock comes into contact with a boss in a fitting disengagement operation, in which FIG. 9A is a state view of the connector, FIG. 9B is an enlarged view of main parts of FIG. 9A, and FIG. 9C is a view of the fitting detection circuit.

FIGS. 10A to 10C are views when the lock passes through the boss in the fitting disengagement operation, in which FIG. 10A is a state view of the connector, FIG. 10B is an enlarged view of main parts of FIG. 10A, and FIG. 10C is a view of the fitting detection circuit.

FIGS. 11A to 11C are views when the fitting disengagement operation is completed, in which FIG. 11A is a state view of the connector, FIG. 11B is an enlarged view of main parts of FIG. 11A, and FIG. 11C is a view of the fitting detection circuit.

FIGS. 12A to 12C are views of the lever and the boss according to a second embodiment of the present invention, in which FIG. 12A is a side view of the lever, FIG. 12B is an enlarged view of main parts of the lever, and FIG. 12C is an enlarged perspective view of the boss.

FIGS. 13A to 13C are views at the start of a fitting operation according to the second embodiment, in which FIG. 13A is a state view of the connector, FIG. 13B is an enlarged view of main parts of FIG. 13A, and FIG. 13C is a view of the fitting detection circuit at the sectional position taken along the line A-A of FIG. 3.

FIGS. 14A to 14C are views when the fitting operation is completed, in which FIG. 14A is a state view of the connector, FIG. 14B is an enlarged view of main parts of FIG. 14A, and FIG. 14C is a view of the fitting detection circuit.

FIGS. 15A to 15C are views when the lock comes into contact with the boss in a fitting disengagement operation, in which FIG. 15A is a state view of the connector, FIG. 15B is an enlarged view of main parts of FIG. 15A, and FIG. 15C is a view of the fitting detection circuit.

FIGS. 16A to 16C are views when the lock passes through the boss in the fitting disengagement operation, in which FIG. 16A is a state view of the connector, FIG. 16B is an enlarged view of main parts of FIG. 16A, and FIG. 16C is a view of the fitting detection circuit.

FIGS. 17A to 17C are views when the fitting disengagement operation is completed, in which FIG. 17A is a state view of the connector, FIG. 17B is an enlarged view of main parts of FIG. 17A, and FIG. 17C is a view of the fitting detection circuit.

FIGS. 18A to 18C are study diagrams for solving the problem, in which FIG. 18A is a view showing a state in which a connector is fitted, FIG. 18B is a view showing a state of the lever in a first action, and FIG. 18C is a view showing a state of the lever when a second action is completed.

DETAILED DESCRIPTION

Figure 1:
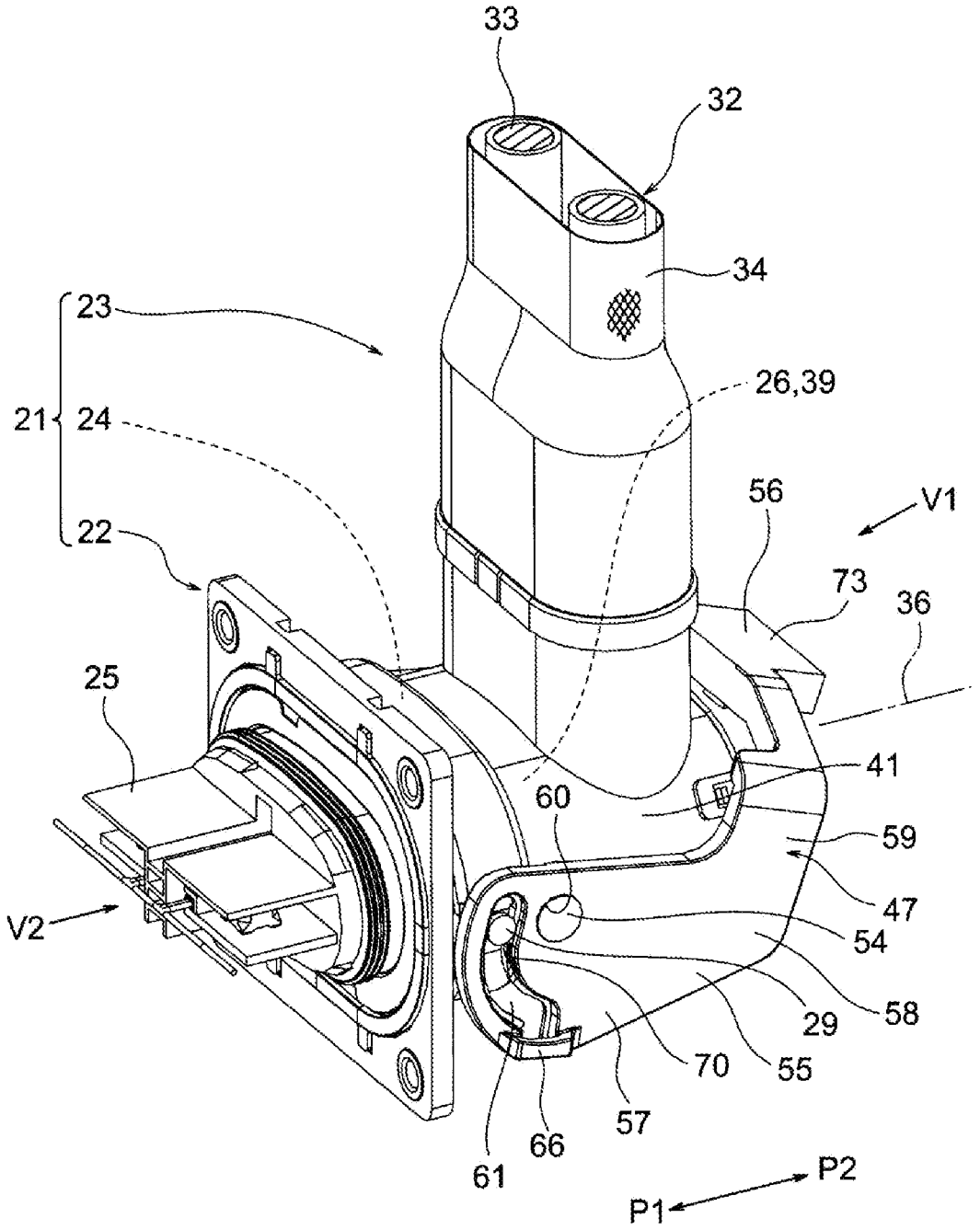
FIG. 1 is a perspective view showing an embodiment of a connector of a first embodiment of the present invention.
Figure 2:
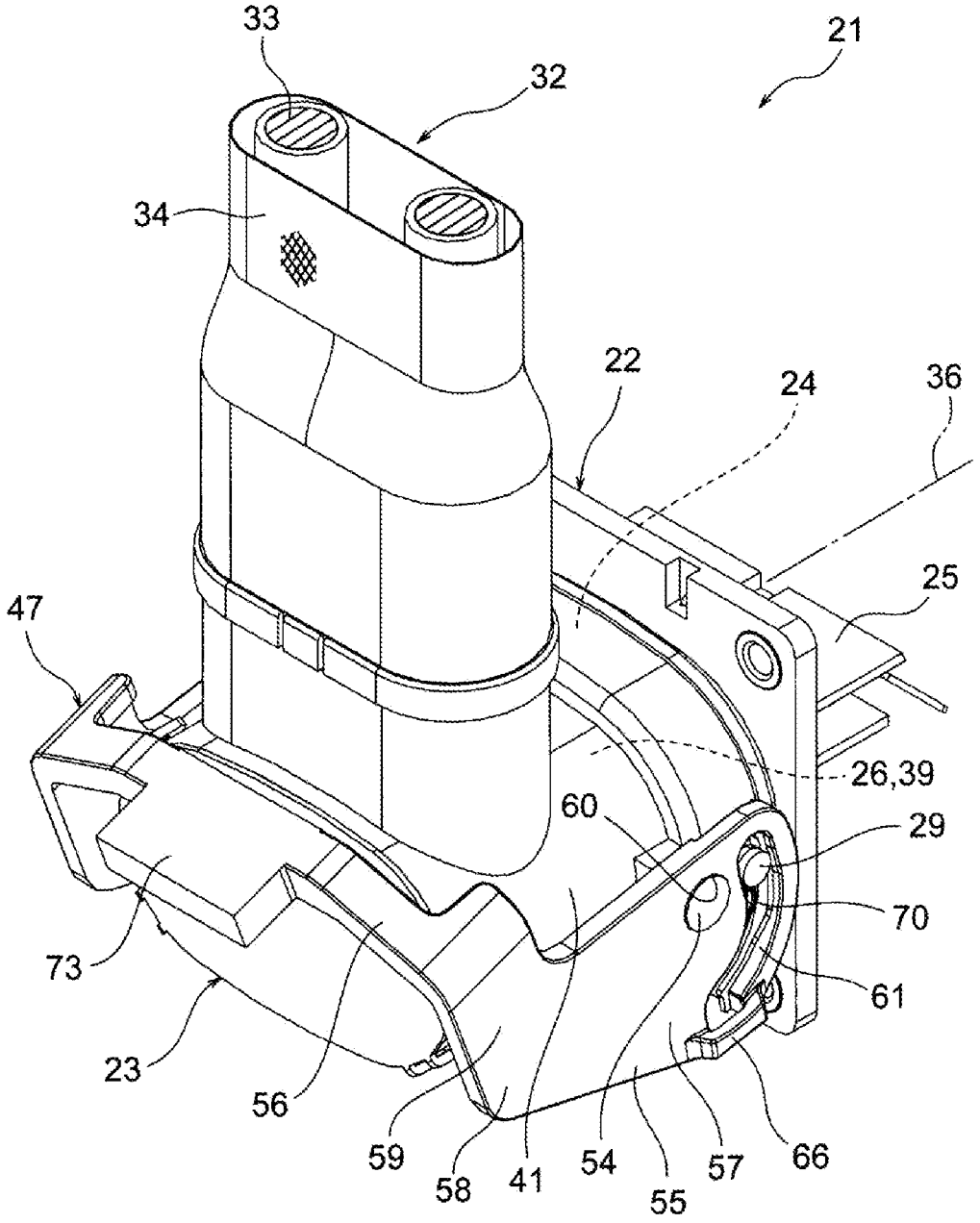
FIG. 2 is a perspective view of the connector as viewed in a direction of an arrow V1 in FIG. 1.
Figure 3:
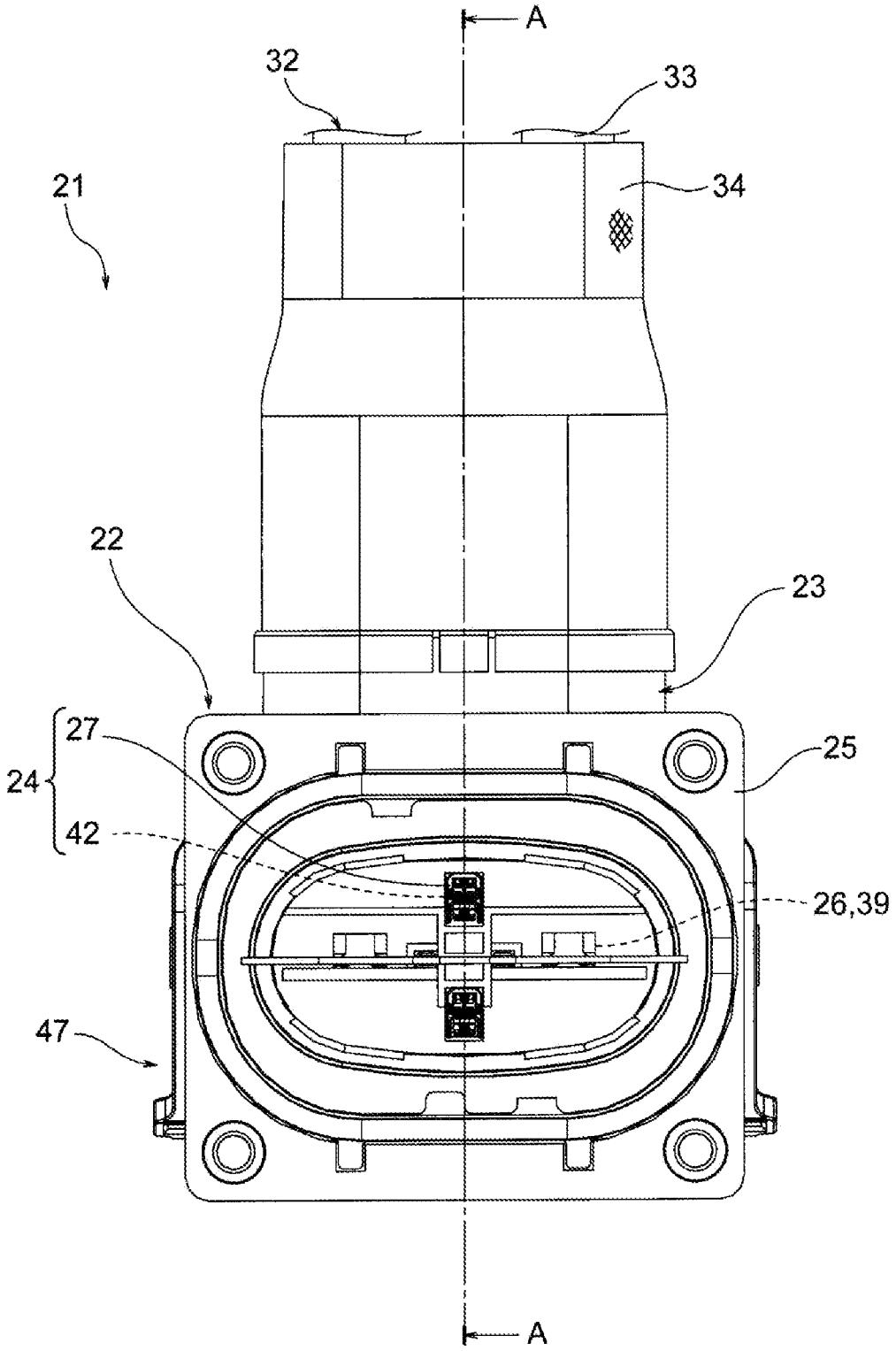
FIG. 3 is a view of the connector as viewed in a direction of an arrow V2 in FIG. 1.
Figure 4:
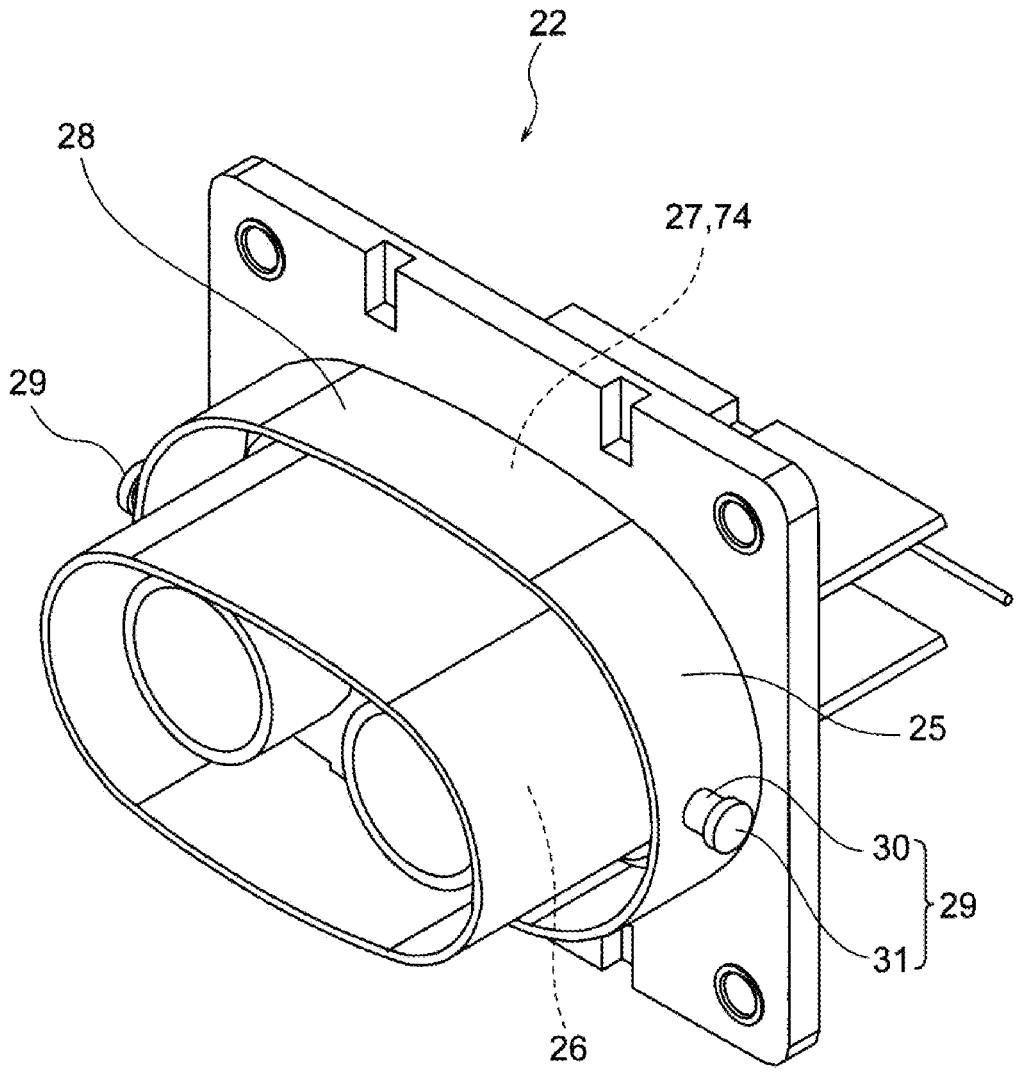
FIG. 4 is a perspective view of a male connector as an example of the second connector.
Figure 5:
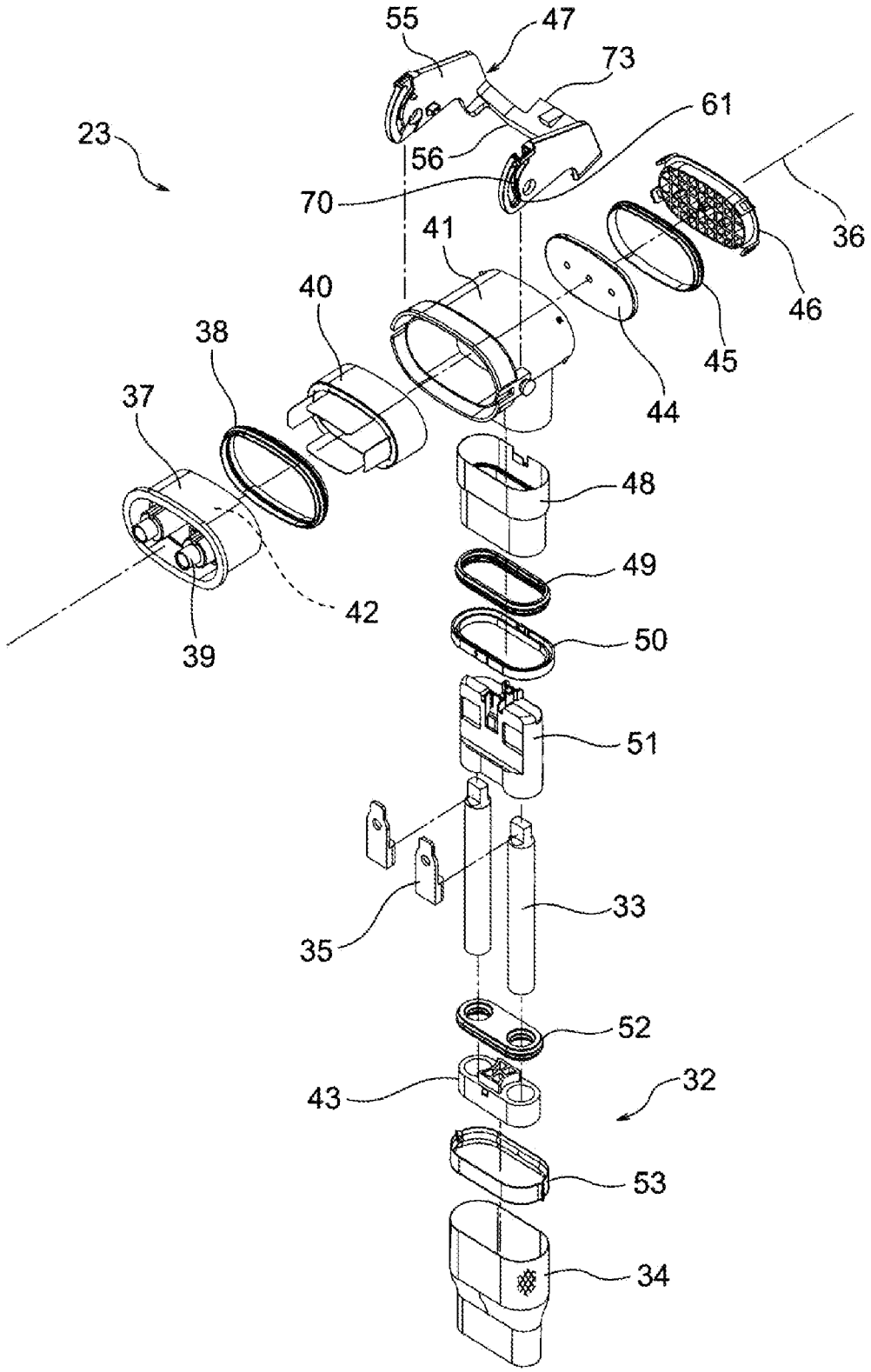
FIG. 5 is an exploded perspective view of a female connector as an example of a first connector.
Figure 6A:
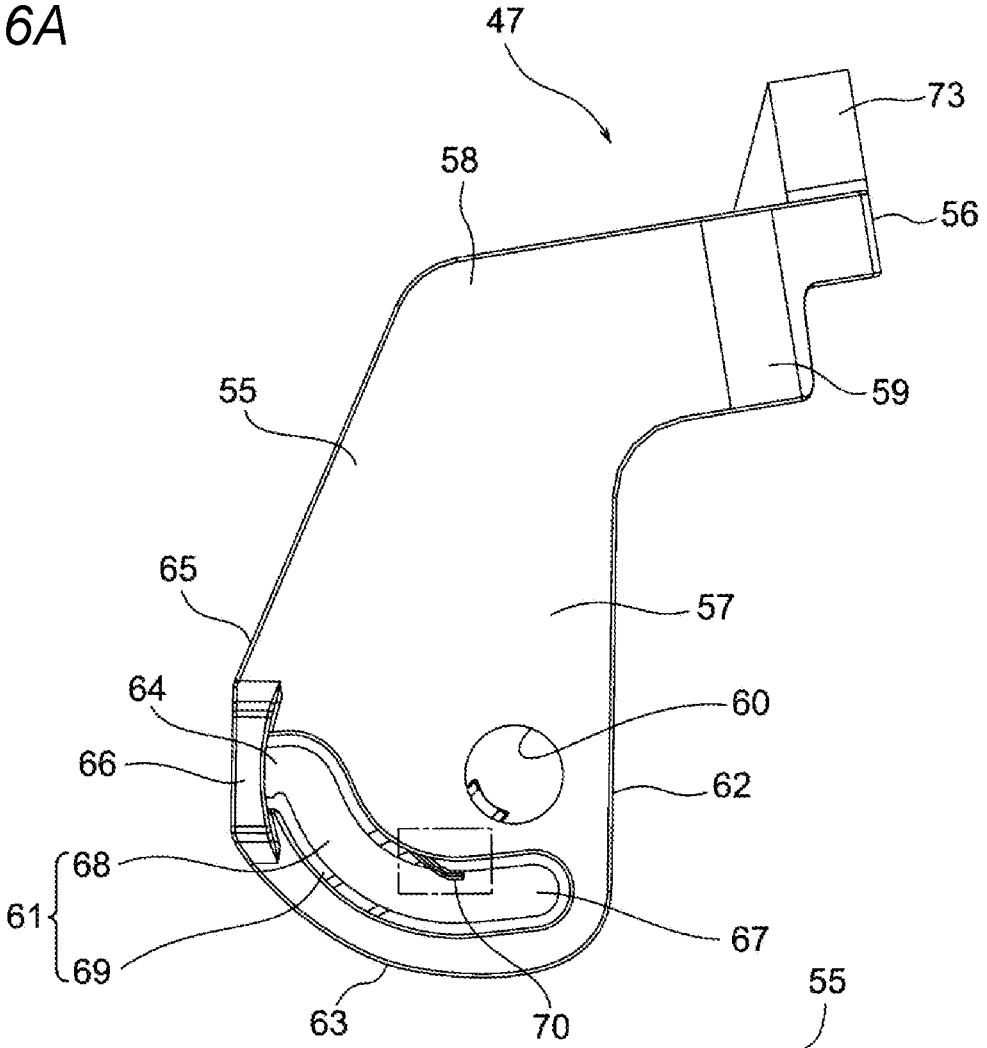
Figure 6B:
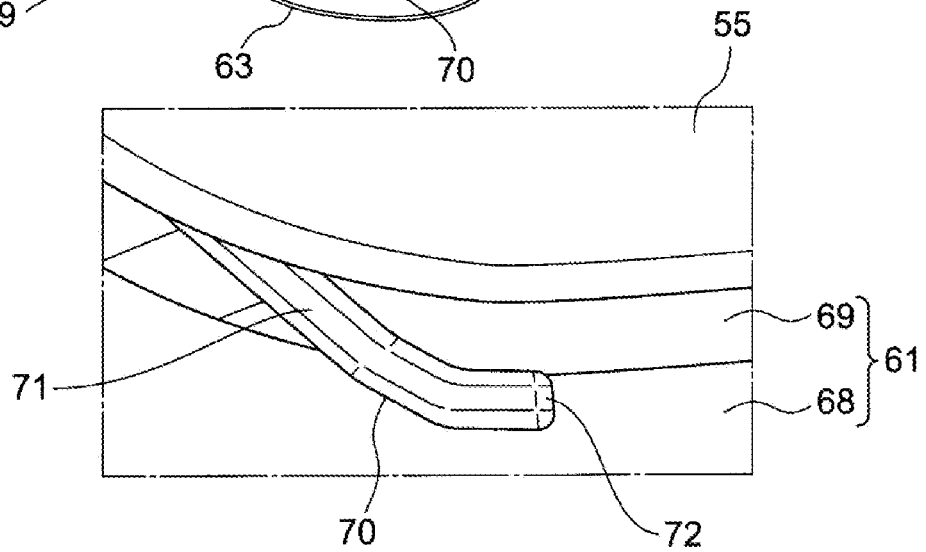

Hereinafter, a first embodiment will be described with reference to the drawings. FIGS. 1 to 3 are views showing a connector according to a first embodiment of the present invention. FIG. 4 is a perspective view of the male connector as an example of a second connector, and FIG. 5 is an exploded perspective view of the female connector as an example of a first connector. FIGS. 6A and 6B are views of the lever, FIGS. 7A to 8C are views of the fitting operation by the lever, and FIGS. 9A to 11C are views of the fitting disengagement operation by the lever.

<Connector 21>

In FIGS. 1 to 3, the connector 21 according to the first embodiment of the present invention is provided in a high-voltage circuit of an electric vehicle, a hybrid vehicle, or the like. The connector 21 is configured to allow electrical connection or disconnection. The connector 21 includes a male connector 22 as an example of a second connector, a female connector 23 as an example of a first connector, and a fitting detection circuit 24 configured to detect fitting of the male connector 22 and the female connector 23. As will be understood from a following description, the connector 21 is configured to serve as a low insertion force (LIF) connector capable of fitting the male connector 22 and the female connector 23 to each other with a low insertion force by applying a principle of leverage. In the present embodiment, the connector 21 has a shielding function (the shielding function is an example). The connector 21 also has a waterproof function. Hereinafter, each of the above configurations will be described.

<Male Connector 22>

In FIGS. 1 to 4, the male connector 22 is provided as a connector which is a counterpart of the female connector 23, that is, a connector which is a fitting counterpart. A main configuration of the male connector 22 includes a housing 25 made of resin, two main terminals 26 having conductivity as an example of second main terminal, and a detection element 27 on a male side. As can be understood from the drawings, the male connector 22 has a structure capable of being fixed to a device, a panel, or the like mounted on a vehicle in a watertight manner. The housing 25 is formed with a connector fitting portion 28 having a hood shape (substantially cylindrical shape) for the female connector 23. A boss 29 is formed on a curved portion of an outer periphery of the connector fitting portion 28.

<Boss 29>

In FIG. 4, bosses 29 are used for connector fitting with the female connector 23, and one boss 29 is disposed on each side of the connector fitting portion 28. That is, the bosses 29 are formed as a pair. Each of the pair of bosses 29 has a columnar shaft portion 30 and a tip end portion 31 continuous with the shaft portion 30, and is formed in an illustrated shape. The boss 29 may be referred to as a "cam pin". The tip end portion 31 is formed in a circular plate shape having a diameter larger than that of the shaft portion 30. It is assumed that a shape of the tip end portion 31 is slightly different from that of a second embodiment (which will be described later with reference to FIGS. 12A to 12C). The shaft portion 30 is formed in a portion with which a boss groove 61, which will be described later, is movably engaged. The tip end portion 31 is formed in a portion having a diameter slightly larger than a groove width (a width of a groove body) of the boss groove 61. The tip end portion 31 is formed at a portion with which a lock 70, which will be described later, comes into contact at the time of the fitting disengagement operation. In addition, an end portion of the lock 70 is formed at a sliding contact portion. Further, the end portion is formed in a portion through which the lock 70 passes. Regarding the boss 29 as described above, the fitting operation and the fitting disengagement operation related to the connector 21 will be described later.

<Female Connector 23>

In FIGS. 1 to 3 and 5, the female connector 23 is provided at ends of a pair of electric wires 33 forming a wire harness 32. The pair of electric wires 33 is covered with a braid 34 in the present embodiment. The braid 34 is formed by braiding a conductive metal wire into a tubular shape. The ends of the pair of electric wires 33 are provided with terminals 35 (here, crimping terminals) having conductivity. The female connector 23 includes, when component members are listed in order from a left to a right on a page of FIG. 5 (when the component members are listed along a connector fitting axis 36), an inner housing 37 made of resin having insulation properties, an annular packing 38 made of rubber, elastomer, or the like, two main terminals 39 having conductivity as an example of a first main terminal, an inner shell 40 made of metal having conductivity, an outer housing 41 having insulation properties, a detection element 42 (interlock circuit) on a female side, a cover shell 44 made of metal having conductivity, an annular cover packing 45 made of rubber, elastomer, or the like, and a cover 46 made of resin having insulation properties.

The female connector 23 includes, when component members are listed in order from a top to a bottom on the page of FIG. 5 (when the component members are listed at a position of the outer housing 41 along a direction perpendicular to the connector fitting axis 36), a lever 47 made of resin having insulation properties, an inner shell 48 made of metal having conductivity, an annular packing 49 made of rubber, elastomer, or the like, a packing holding member 50 facing the packing 49, a shell 51 in which the terminals 35 are accommodated, a mat seal 52 made of rubber, elastomer, or the like, a mat seal holder 43, and a shield link 53 made of a metal for holding the braid 34.

<Lever 47>

In FIGS. 2, 5, 6A and 6B, the lever 47 is a member that is assembled to a pair of rotation shafts 54 protruding from an outer peripheral surface of the outer housing 41 and is rotatable, and is formed in a substantially U shape shown in the drawings including a pair of arm plates 55 and a connecting portion 56 connecting the arm plates 55. The lever 47 straddles the outer housing 41. The lever 47 is formed so that an operator can hold an operation portion 73 (to be described later) of the connecting portion 56 with a hand and rotationally move the operation portion 73. Outer sides and the inner sides of the pair of arm plates 55 are formed in the same shape. Since the arm plates 55 have the same shape, one arm plate 55 of the pair of arm plates 55 will be described. The arm plate 55 is formed in a plate portion having a substantially L-shaped outer shape. When a portion of the arm plate 55 to be assembled to the housing 41 is a base portion 57, the arm plate 55 has a bent portion 58 and a plate end portion 59 in addition to the base portion 57. The base portion 57 is formed in a portion where a relatively large area is ensured. A bearing hole 60 and the boss groove 61 are formed in such a base portion 57.

<Bearing Hole 60 and Boss Groove 61>

In FIGS. 6A to 7C, the bearing hole 60 is formed in a circular through hole portion that receives the rotation shaft 54 of the outer housing 41 so as to be rotatable about the rotation shaft 54. The bearing hole 60 is disposed not at a center of the base portion 57 but on a side closer to a side portion 62 of the base portion 57. The boss groove 61 is formed in a groove portion lying between an arc-shaped side portion 63 and the bearing hole 60 of the base portion 57, and movably engages the boss 29. The boss groove 61 is formed so as to extend in accordance with a shape of the arc-shaped side portion 63. The boss groove 61 may be referred to as a "cam groove". A groove start portion 64 of such a boss groove 61 is formed so as to cut out a continuous portion between a side portion 65 and the arc-shaped side portion 63 of the base portion 57. A bridge portion 66 is formed at a position of the groove start portion 64 so as to straddle the groove start portion 64. A groove end portion 67 of the boss groove 61 is disposed near a continuous portion between the side portion 62 and the arc-shaped side portion 63 of the base portion 57. The boss groove 61 is formed in a shape in which an edge of the groove is stepped. Specifically, the boss groove 61 is formed in an illustrated shape having a groove body 68 and a groove stepped portion 69. The groove body 68 is formed in a portion that is movable with respect to the shaft portion 30 of the boss 29 of the male connector 22. The groove body 68 is formed to have a groove width slightly larger than the diameter of the shaft portion 30 of the boss 29. The groove stepped portion 69 is formed in a portion where (a rear surface of) the tip end portion 31 of the boss 29 is in sliding contact with the groove stepped portion 69. As described above, the boss groove 61 is formed in such a shape that the lever 47 does not fall off from the boss 29 in a middle of the groove because the tip end portion 31 of the boss 29 is in sliding contact with the groove stepped portion 69 (a state in which the tip end portion 31 exists). In addition, the boss groove 61 is formed in a shape having the lock 70 for making the fitting disengagement operation into two actions described later.

<Lock 70>

In FIGS. 6A to 7C, the lock 70 includes a base end disposed in the groove stepped portion 69 of the boss groove 61, and protrudes toward an inner side of the boss groove 61. In addition, the lock 70 is disposed on a groove side portion closer to the bearing hole 60 of two groove side portions extending along an extending direction of the boss groove 61. The lock 70 is formed in a portion where a rotation of the lever 47 is locked, when the lock 70 contacts the boss 29 in the fitting disengagement operation to be described later, in a state where the fitting detection circuit 24 is in an off state (in a state where the fitting of the male connector 22 and the female connector 23 is not detected, in other words, the non-fitting of the male connector 22 and the female connector 23 is detected) and also in a state where the main terminals 26 and 39 are connected (a specific action will be described later). The lock 70 of the present embodiment is formed in a cantilever arm shape (protruding shape). The lock 70 having the cantilever arm shape includes a deformation allowing portion 71 extending obliquely from the groove stepped portion 69 in a plan view of the boss groove 61, and a contact portion 72 continuous with the deformation allowing portion 71. The deformation allowing portion 71 is formed in a portion that allows elastic deformation of the lever 47 (elastic deformation of the lock 70 in the present embodiment). In other words, the lever 47 of the present embodiment includes a deformation allowing portion 71 that allows elastic deformation of the lever 47, the deformation allowing portion 71 being provided in the lock 70. The deformation allowing portion 71 is formed in an oblique shape portion that can be bent in a direction approaching the groove side portion closer to the bearing hole 60 of the boss groove 61. The contact portion 72 is formed at a portion extending in a direction in which the deformation allowing portion 71 is inclined with respect to an extending direction. The contact portion 72 has the same width as the deformation allowing portion 71. The contact portion 72 has a length shorter than that of the deformation allowing portion 71. The contact portion 72 is disposed such that a tip end thereof faces the groove end portion 67 of the boss groove 61. The tip end of the contact portion 72 is formed in a shape having a curved surface. The tip end of the contact portion 72 is formed at a portion where contact occurs so as to abut against a side face (outer peripheral surface) of the tip end portion 31 of the boss 29. The tip end of the contact portion 72 is formed at a portion in sliding contact with the side face (outer peripheral surface) after the contact. At the time of the sliding contact, it is assumed that the deformation allowing portion 71 is bent.

<Connecting Portion 56>

Figures 18A, 18B, 18C:
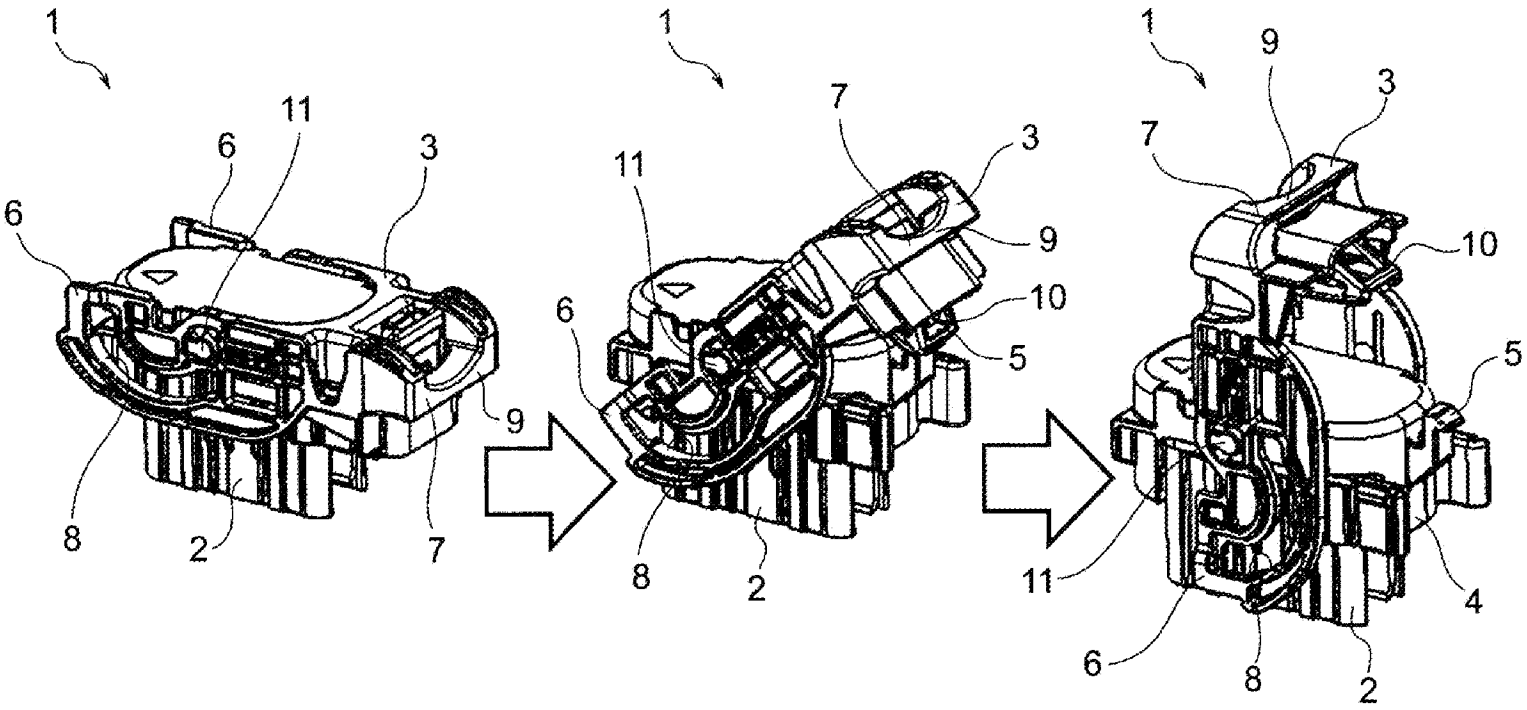
FIG. 18A RELATED ART
FIG. 18B RELATED ART
FIG. 18C RELATED ART

In FIGS. 2, 5, 6A, and 6B, the connecting portion 56 is formed at a portion connecting respective plate end portions 59 of the pair of arm plates 55. The connecting portion 56 is formed in a bridge shape that is slightly curved. The operation portion 73 is formed at a center of such a connecting portion 56. The operation portion 73 is formed as a portion which is held by a hand of the operator to perform the fitting operation and the fitting disengagement operation of the lever 47. It is assumed that the operation portion 73 does not have a locking portion as shown in a study diagram FIGS. 18A to 18C.

<Detection Elements 27, 42 on Male, Female Sides>

In FIGS. 3, 7A to 7C, the detection elements 27, 42 on the male, female sides form the fitting detection circuit 24, and are provided in the male connector 22 and the female connector 23, respectively. The fitting detection circuit 24 forms a so-called interlock circuit configured to be able to prohibit conduction of the male connector 22 and the female connector 23 in a state where the male connector 22 and the female connector 23 are not completely fitted. The fitting detection circuit 24 is configured such that, when a terminal 74 of the detection element 27 on the male side and a terminal 75 of the detection element 42 on the female side are electrically connected to each other, the circuit itself is in a closed state. Accordingly, it can be understood that the male connector 22 and the female connector 23 are completely fitted to each other.

<Fitting Operation by Lever 47>

Figure 7A:
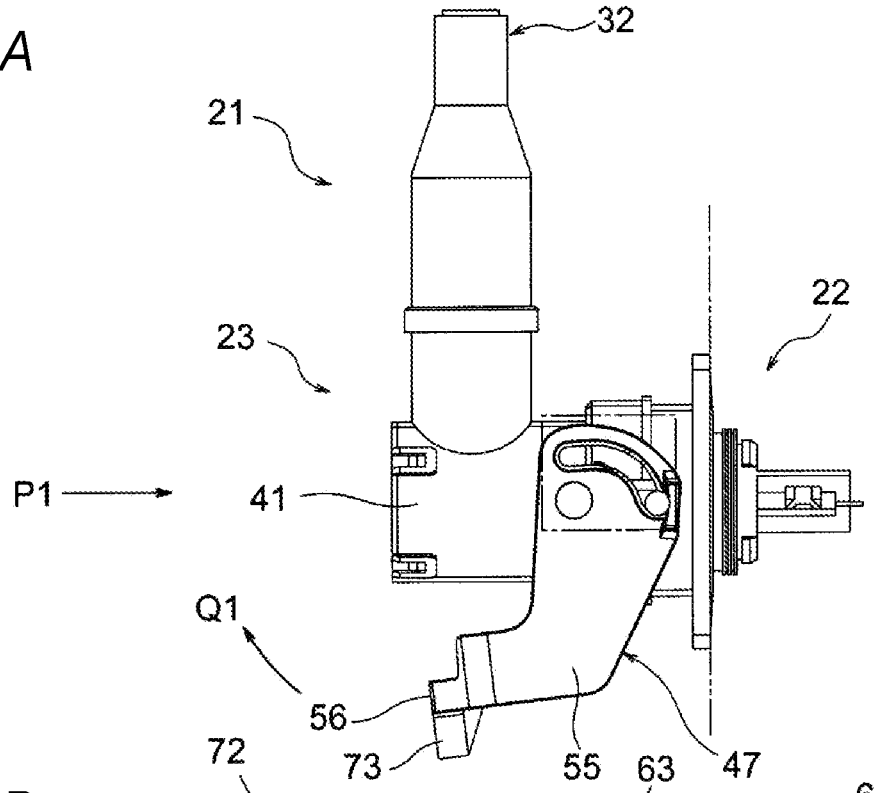
Figure 7B:
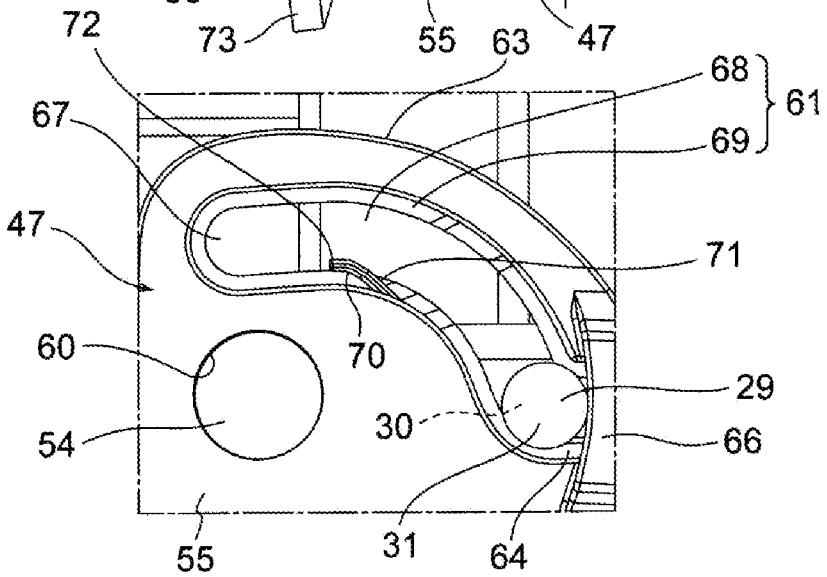
Figure 7C:
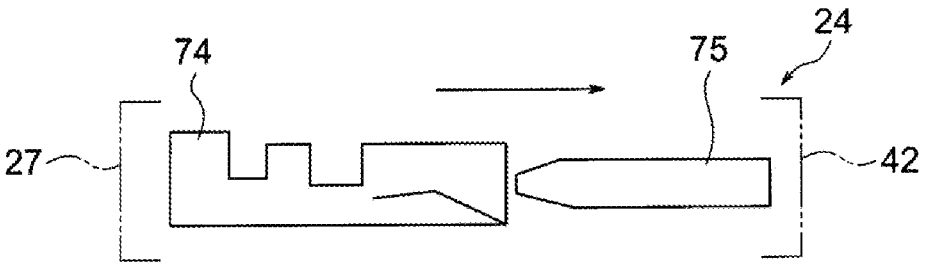

In FIGS. 7A to 7C, when the female connector 23 is inserted into the male connector 22 in a fitting direction of an arrow P1, the groove start portion 64 of the lever 47 before the operation receives therein the boss 29 at this time. As shown in FIG. 7A, the lever 47 is in a state in which the operation portion 73 is at a lowermost position. In addition, the terminal 74 and the terminal 75 of the fitting detection circuit 24 (see FIG. 3) are in a non-contact state, and the fitting detection circuit 24 is not in a closed state. Although not particularly shown in FIGS. 7A to 7C, the main terminals 26 (see FIG. 4) and the main terminals 39 (see FIG. 5) are also in the non-contact state. That is, the male connector 22 and the female connector 23 are in a non-conducting state. States shown in FIGS. 7A to 7C are states before the connector fitting is started.

When the operator rotates the lever 47 in a direction of an arrow Q1 shown in FIG. 7A while holding the operation portion 73, the lever 47 rotates about the bearing hole 60 and the rotation shaft 54. Since the lever 47 is such a member, the boss groove 61 moves from a position of FIG. 7B to a position of FIG. 8B with respect to the boss 29. That is, the boss groove 61 moves from the groove start portion 64 to the groove end portion 67 with respect to the boss 29. During this movement, the lock 70 passes through the boss 29. When passing through the boss 29, the lock 70 bends in the direction in which the deformation allowing portion 71 approaches a groove side portion of the boss groove 61, and elastically returns to an original state after passing.

Figure 8A:
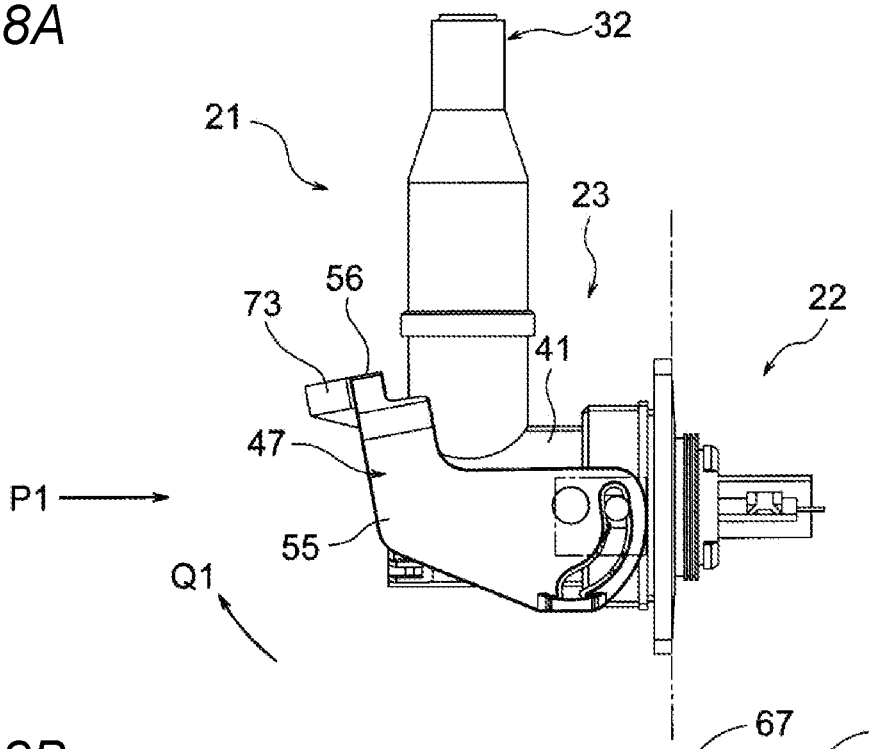
Figure 8B:
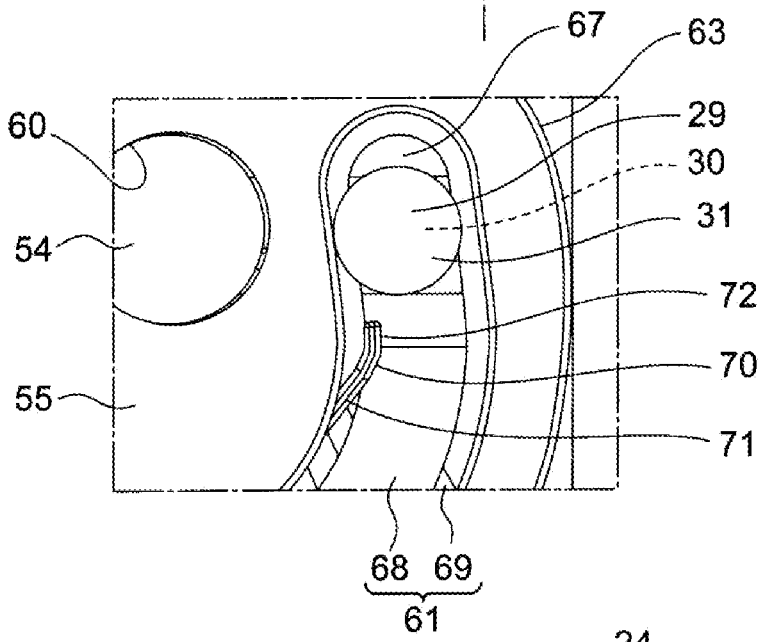
Figure 8C:
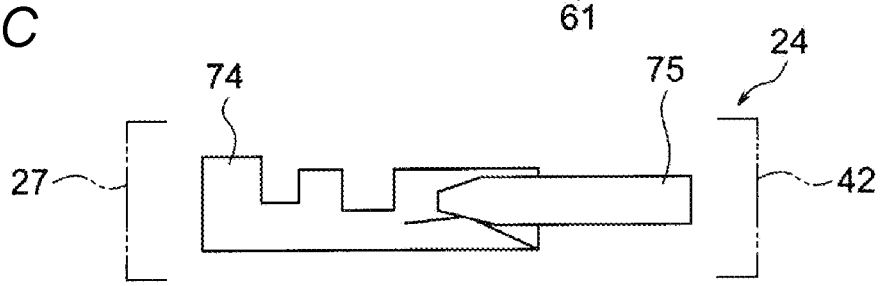

In FIGS. 8A to 8C, when the boss groove 61 moves to the position of the groove end portion 67 with respect to the boss 29 (when the operation portion 73 moves to an uppermost position in a state of the lever 47), the fitting operation by the lever 47 is completed, and the male connector 22 and the female connector 23 are brought into a conductive state. That is, the main terminals 26 (see FIG. 4) of the male connector 22 and the main terminals 39 (see FIG. 5) of the female connector 23 are brought into a contact state, and the terminals 74 and 75 of the fitting detection circuit 24 (see FIG. 3) are also brought into the contact state (a state in which the fitting detection circuit 24 is in the closed state and an ON state, i.e., a state in which the fitting of the male connector 22 and the female connector 23 is detected), so that the connector 21 is in a state in which the connector fitting is completed, as shown in FIG. 8A. It is assumed that after the lock 70 passes through the boss 29 and before the groove end portion 67 moves to a position of the boss 29, the fitting detection circuit 24 is in the closed state, and thus the male connector 22 and the female connector 23 are brought into the conductive state.

<Fitting Disengagement Operation by Lever 47>

In states where the connectors are fitted as shown in FIGS. 8A to 8C, when the female connector 23 is disengaged from the male connector 22 for maintenance, for example, a following operation is performed. In other words, the operator operates as follows to release or disengage the connector fitting. An operation of the operator will be understood from the following description, whereas the operation does not require a change of hands.

Figure 9A:
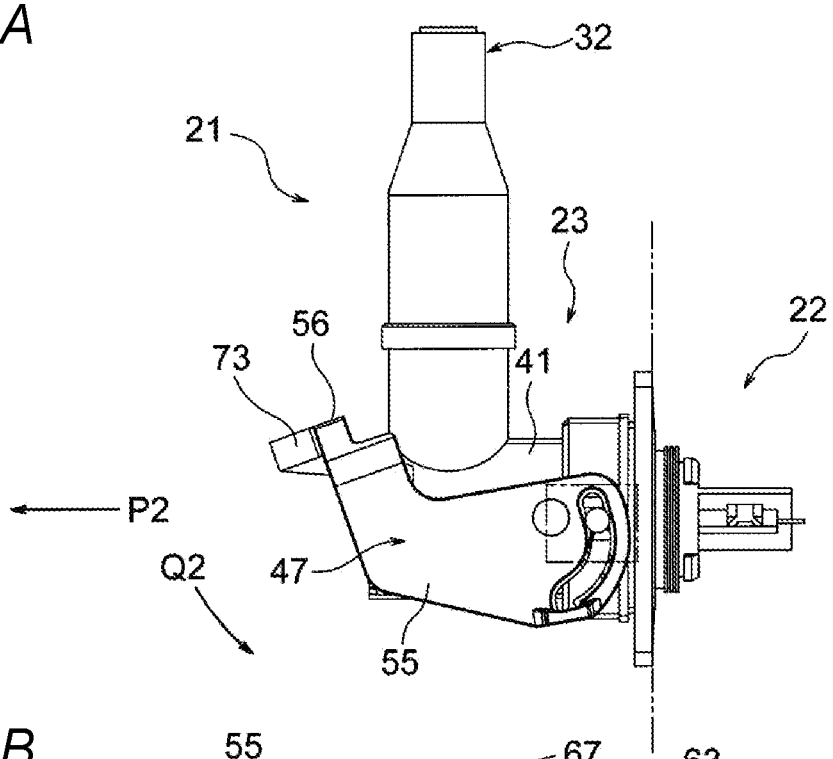
Figure 9B:
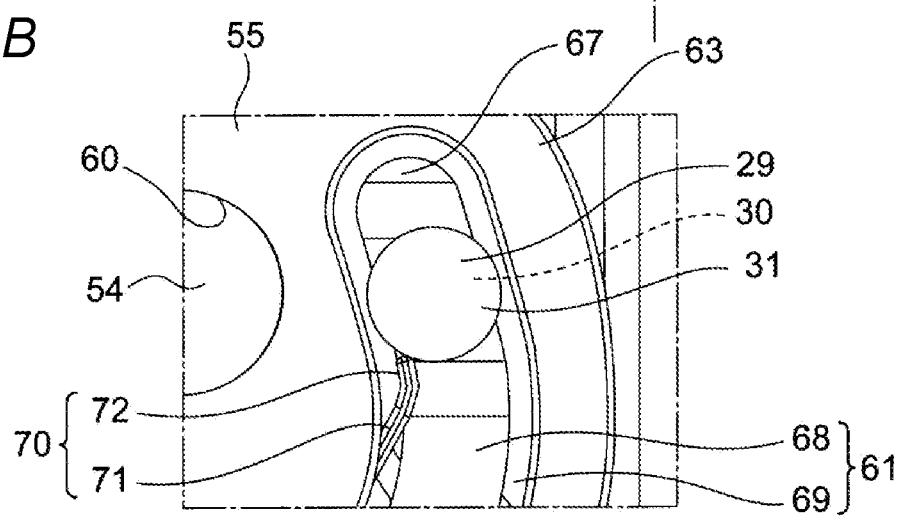
Figure 9C:
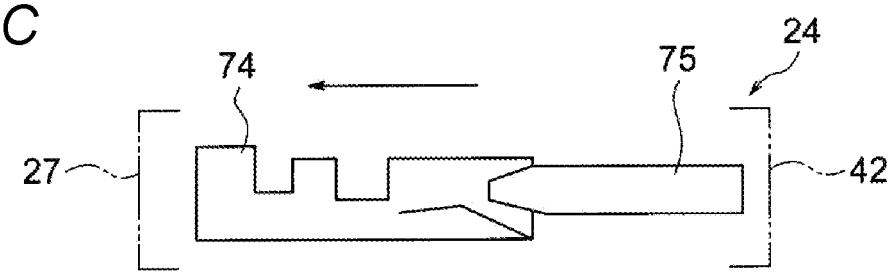
Figure 10A:
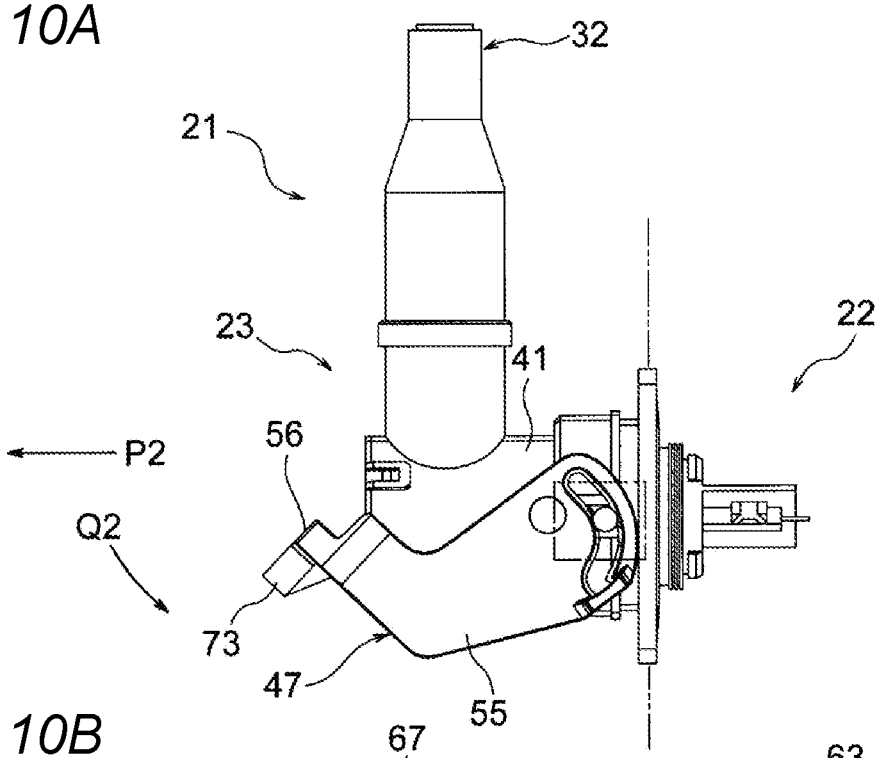
Figure 10B:
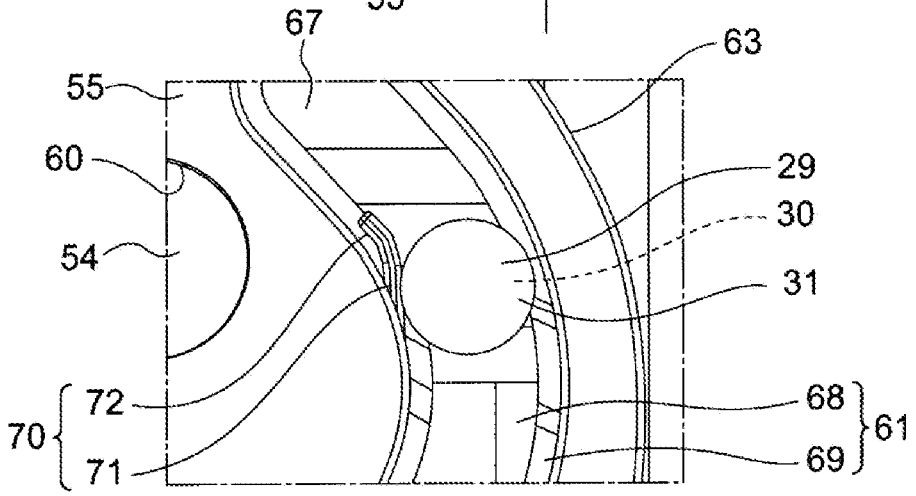
Figure 10C:
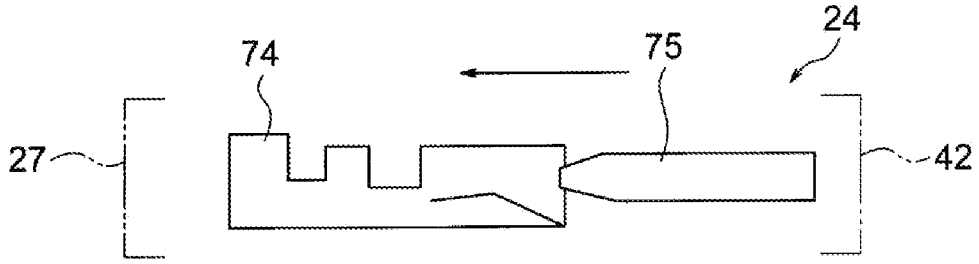

When the operator rotates the lever 47 in a direction of an arrow Q2 shown in FIG. 9A while holding the operation portion 73, the boss groove 61 moves with respect to the boss 29. Immediately after starting to move, the lock 70 of the lever 47 comes into contact with the boss 29. Specifically, the tip end of the contact portion 72 of the lock 70 abuts against the side face (outer peripheral surface) of the tip end portion 31 of the boss 29 so as to contact. Until this contact, the female connector 23 begins to move in a fitting disengagement direction of an arrow P2 by an action of the lever 47. When the female connector 23 starts to move in the fitting disengagement direction, the main terminals 39 (see FIG. 5) of the female connector 23 slide in a direction in which the main terminals 39 are not in contact with the main terminals 26 (see FIG. 4) of the male connector 22. In addition, the terminal 74 and the terminal 75 of the fitting detection circuit 24 (see FIG. 3) also slide similarly to be in the non-contact state as shown in FIG. 9C. Since the fitting detection circuit 24 is opened (set in an off state) in this state, the conduction between the male connector 22 and the female connector 23 is released.

Figure 11A:
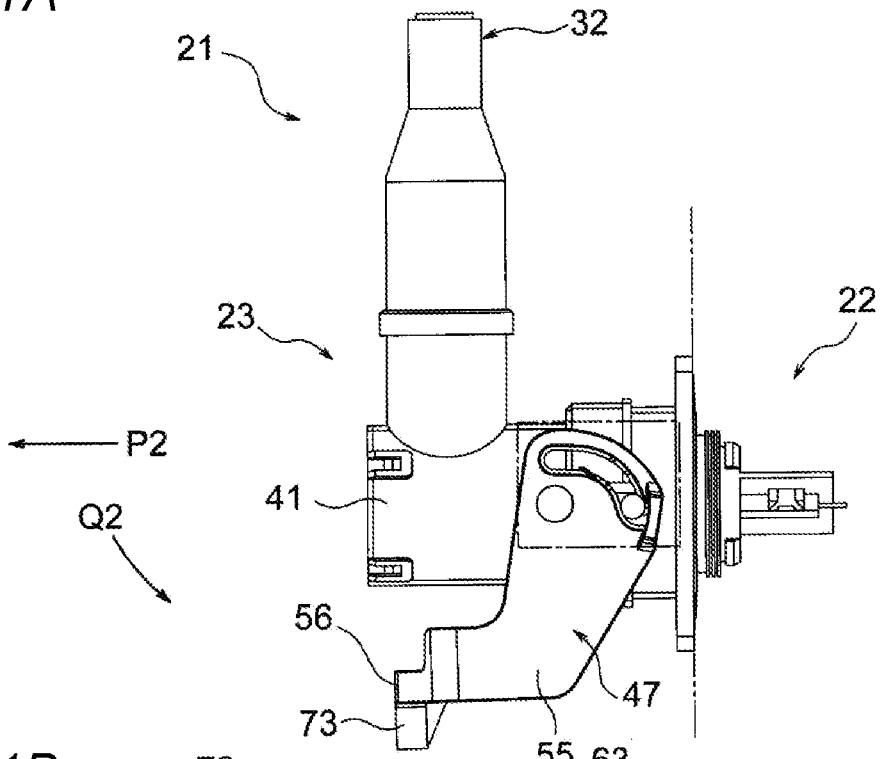
Figure 11B:
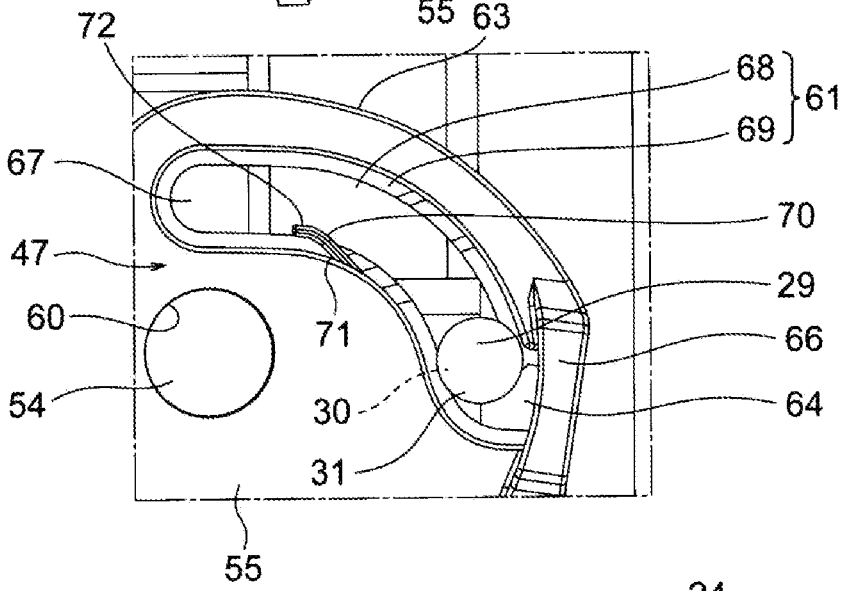
Figure 11C:
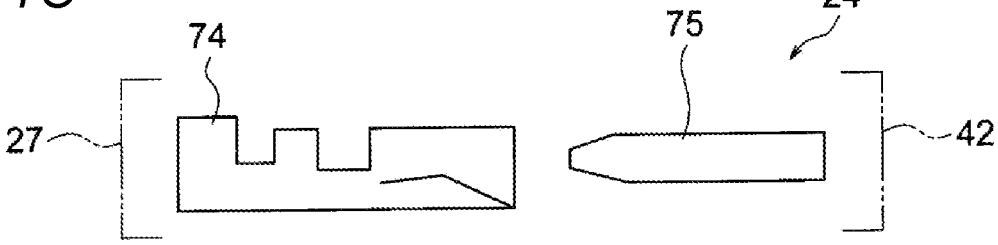

When the lock 70 comes into contact with the boss 29, the rotation of the lever 47 is locked at this time. A feeling caused by the contact is transmitted to the operator. In the present embodiment, the contact feeling is momentary. This is because the tip end of the contact portion 72 is in sliding contact with the side face (the outer peripheral surface which is a curved surface) of the tip end portion 31 of the boss 29, and the lock 70 bends so as to approach the groove side portion of the boss groove 61. When the contact feeling is transmitted, the operator can know that the fitting detection circuit 24 is in an open state (OFF state). When the lock 70 bends, the locking of the rotation of the lever 47 is released. The lever 47 allows the lock 70 to pass through the boss 29 (see FIGS. 10A to 10C) with only a slight increase in the operation force by the operator. The is, the lock 70 is configured to release locking of the rotation of the lever 47 when an operation force of the fitting disengagement operation larger than a threshold is applied in a state where the lock 70 contacts the boss 29 (in other words, when a force applied to the lock 70 is larger than a threshold, the force being generated by a relative movement of the boss groove 61 and the boss 29 in response to rotation of the lever 47 in the direction of the arrow Q2 in a state where the lock 70 contacts the boss 29). When the fitting disengagement operation of the lever 47 is continued and the groove start portion 64 of the boss groove 61 moves to a position of the boss 29 as shown in FIGS. 11A to 11C, the operation by the lever 47 is completed, and the female connector 23 can be detached from the male connector 22 along the direction of the arrow P2.

In the fitting disengagement operation above by the lever 47, it is possible to take two actions including an action (first action) until the fitting detection circuit 24 is brought into an open state (OFF state) and an action after that (second action). In addition, in the fitting disengagement operation, it is possible to smoothly continue the operation without the operator changing hands in middles of the first action and the second action.

<Effects>

As described above with reference to FIGS. 1 to 11C, according to the connector 21 of the first embodiment of the present invention, when the fitting disengagement operation is performed by the lever 47, the lock 70 of the lever 47 comes into contact with the boss 29, so that the rotation of the lever 47 can be momentarily locked by this contact. Then, by the contact between the lock 70 and the boss 29, the fitting disengagement operation can be made into two actions before and after the contact. Therefore, according to the connector 21, there is an effect that the fitting disengagement operation can be made into two actions and the operation can be performed smoothly.

Figure 12A:
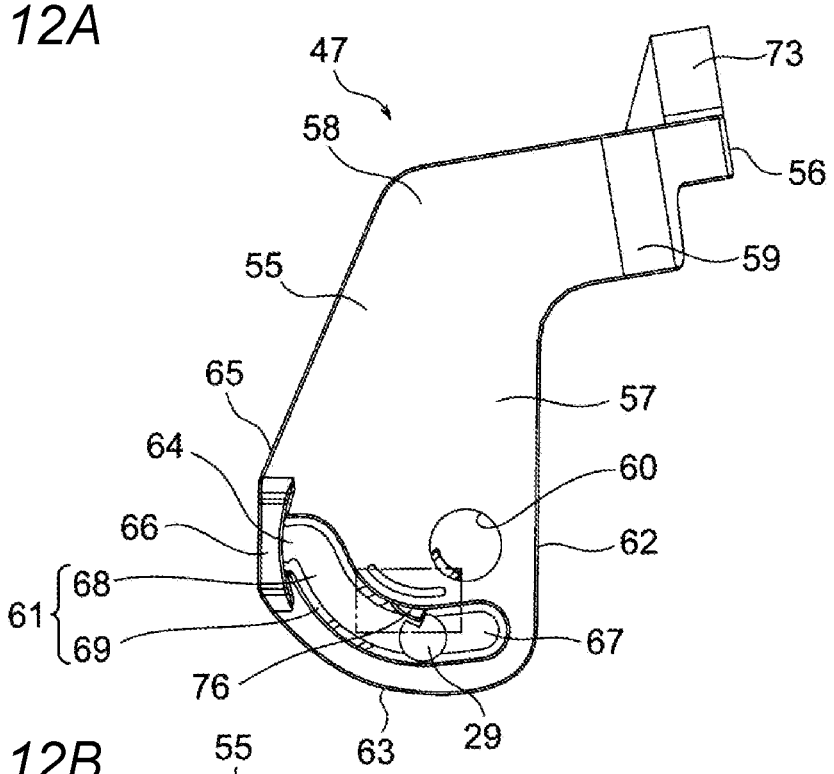
Figure 12B:
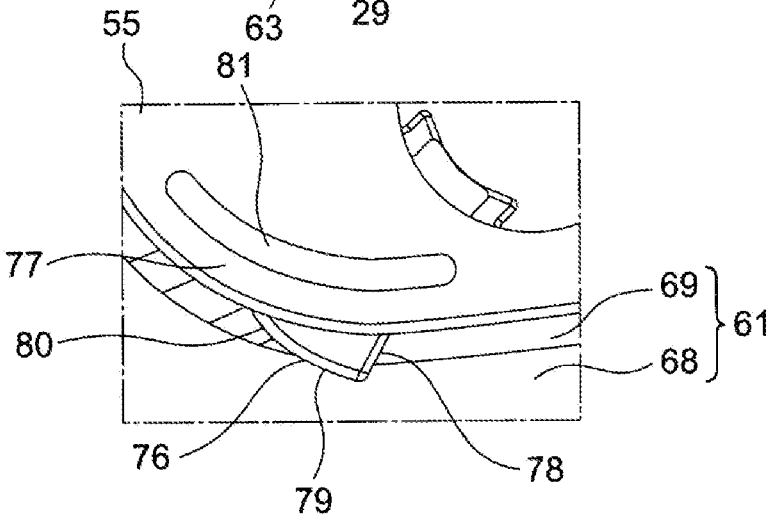
Figure 12C:
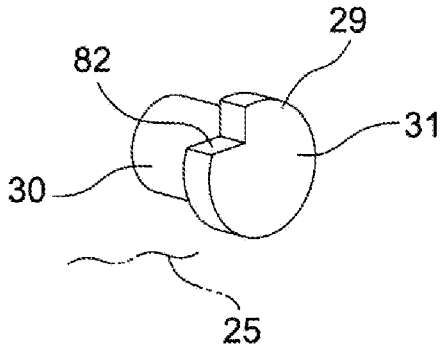

Hereinafter, the second embodiment will be described with reference to the drawings. FIGS. 12A to 12C are views of the lever and the boss according to the second embodiment. FIGS. 13A to 14C are views of the fitting operation by the lever, and FIGS. 15A to 17C are views of the fitting disengagement operation by the lever. Component members that are basically the same as those of the first embodiment above are denoted by the same reference signs, and a detailed description thereof is omitted.

<Lever 47>

In FIGS. 12A and 12B, the lever 47 of the second embodiment is different in that the lock 70 (see FIGS. 6A and 6B) of the first embodiment is replaced with a lock 76, and the deformation allowing portion 71 (see FIGS. 6A and 6B) of the lock 70 of the first embodiment is replaced with a deformation allowing portion 77. Hereinafter, only differences are described. The lock 76 of the second embodiment is formed in the portion where the rotation of the lever 47 is locked by coming into contact with the boss 29 by the fitting disengagement operation to be described later in the state where the fitting detection circuit 24 is OFF and the main terminals 26 and 39 are connected (a specific action will be described later).

<Lock 76>

In FIGS. 12A to 13C, the lock 76 is formed in a protruding piece shape (protruding shape) protruding from the groove stepped portion 69 of the boss groove 61 toward an inner side of the boss groove 61 in a plan view of the boss groove 61. The lock 76 of the protruding piece shape is formed in an illustrated shape having a contact portion 78, a first sliding contact portion 79, and a second sliding contact portion 80 on an outer shape portion thereof. The contact portion 78 includes a corner portion having a substantially right angle (an angle slightly larger than a right angle), and is formed at a portion coming into contact with a cutout portion 82 of the boss 29 to be described later. The contact portion 78 is formed in a portion to be contacted by the cutout portion 82 and then immediately comes off from the cutout portion 82. The first sliding contact portion 79 is a "side" portion continuous with the contact portion 78, and is formed at a portion in sliding contact with the side face (outer peripheral surface) of the tip end portion 31 of the boss 29. The second sliding contact portion 80 is an "oblique side" portion continuous with the first sliding contact portion 79, and is formed at a portion in sliding contact with the side face (outer peripheral surface) of the tip end portion 31 similarly to the first sliding contact portion 79.

<Deformation Allowing Portion 77>

In FIGS. 12A to 13C, the lever 47 of the present embodiment includes the deformation allowing portion 77 that allows elastic deformation of the lever 47, the deformation allowing portion 77 being provided in the vicinity of the lock 76. The deformation allowing portion 77 is disposed between the groove stepped portion 69 at a position where the lock 76 is formed and the bearing hole 60 of the lever 47. The deformation allowing portion 77 is formed in a bendable portion that narrows a groove width of a narrow groove portion 81 for the deformation allowing portion 77. The bending to narrow the groove width is caused when the lock 76 passes through the boss 29. After the deformation allowing portion 77 bends, the deformation allowing portion 77 elastically returns to the original state. It is assumed that a width of the narrow groove portion 81 by an amount of bending required when the lock 76 passes through the boss 29 is ensured. The narrow groove portion 81 is formed in an arc shape along the boss groove 61.

<Boss 29>

In FIG. 12C, the boss 29 according to the second embodiment includes the shaft portion 30 and the tip end portion 31, and is formed in an illustrated shape. The boss 29 is different from the boss 29 of the first embodiment (see FIGS. 7A and 7B) in that the boss 29 includes the cutout portion 82. The cutout portion 82 is disposed in the tip end portion 31. The cutout portion 82 is formed by cutting out in a V shape of substantially 90 degrees. The cutout portion 82 is disposed at a position where the lock 76 can contact the cutout portion 82.

<Fitting Operation by Lever 47>

Figure 13A:
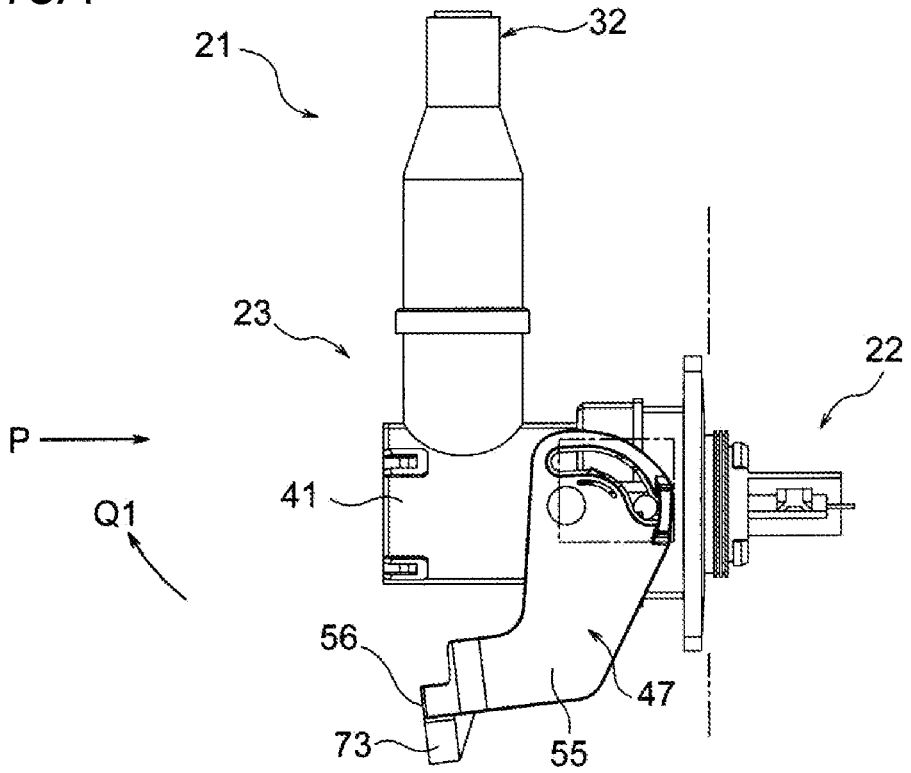
Figure 13B:
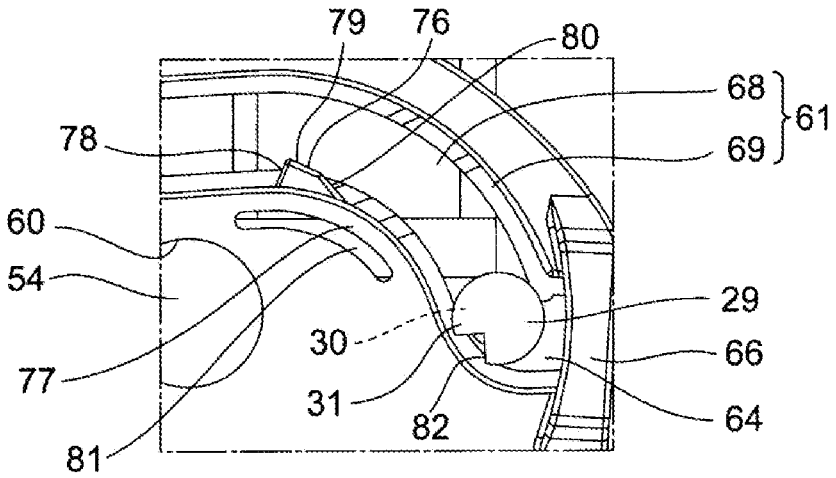
Figure 13C:
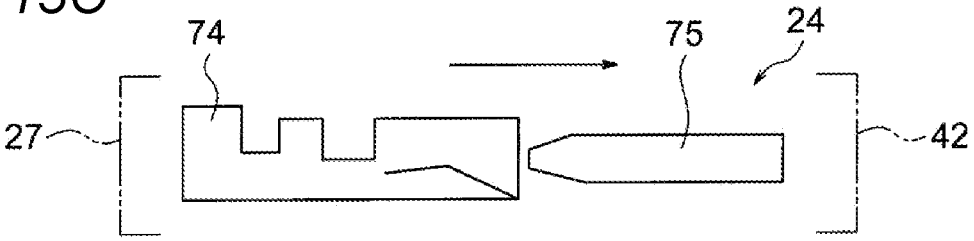

In FIGS. 13A to 13C, when the female connector 23 is inserted into the male connector 22 in the fitting direction of the arrow P1, the groove start portion 64 of the lever 47 before the operation receives therein the boss 29 at this time. As shown in FIG. 13A, the lever 47 is in the state in which the operation portion 73 is at the lowermost position. In addition, the terminal 74 and the terminal 75 of the fitting detection circuit 24 (see FIG. 3) are in the non-contact state, and the fitting detection circuit 24 is not in the closed state. Although not particularly shown in FIGS. 13A to 13C, the main terminals 26 (see FIG. 4) and the main terminals 39 (see FIG. 5) are also in the non-contact state. That is, the male connector 22 and the female connector 23 are in the non-conducting state. States shown in FIGS. 13A to 13C are states before the connector fitting is started.

When the operator rotates the lever 47 in the direction of the arrow Q1 shown in FIG. 13A while holding the operation portion 73, the lever 47 rotates about the bearing hole 60 and the rotation shaft 54. Since the lever 47 is such a member, the boss groove 61 moves from a position of FIG. 13B to a position of FIG. 14B with respect to the boss 29. That is, the boss groove 61 moves from the groove start portion 64 to the groove end portion 67 with respect to the boss 29. During this movement, the lock 76 passes through the boss 29. When the lock 76 passes through the boss 29, the deformation allowing portion 77 is pushed and bent by the lock 76, and elastically returns to the original state after the bending.

Figure 14A:
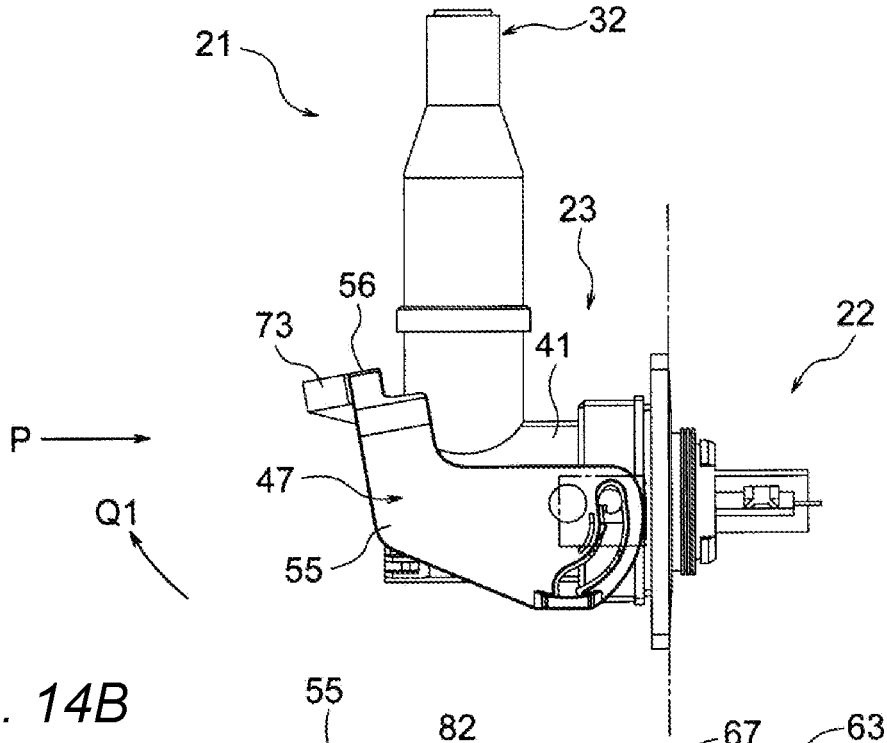
Figure 14B:
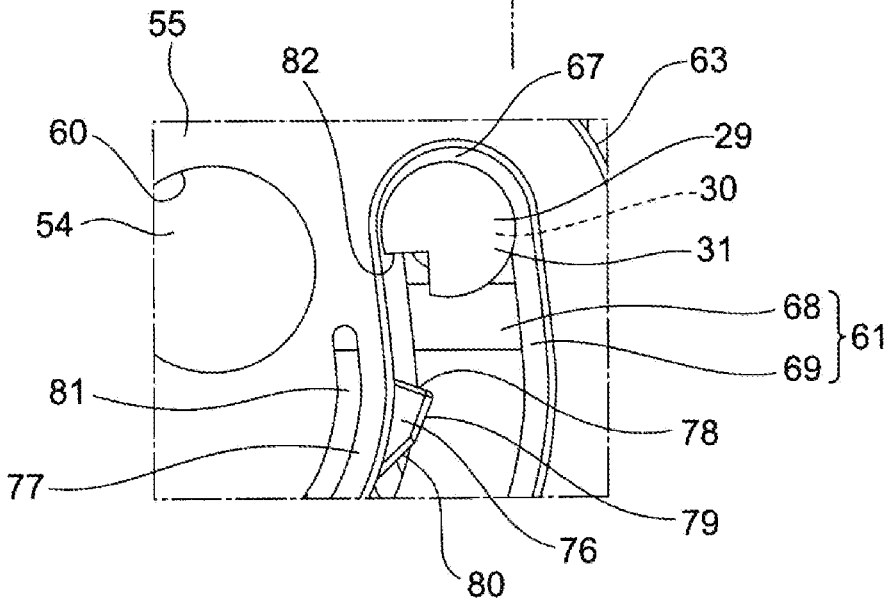
Figure 14C:
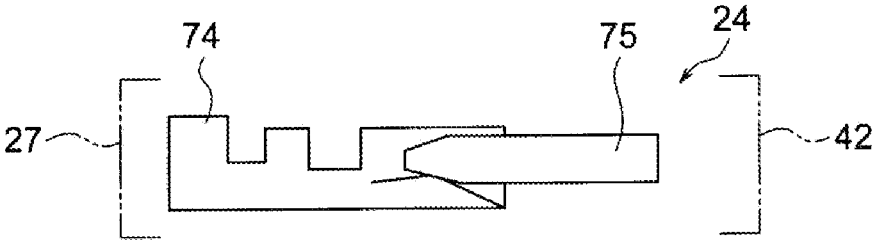

In FIGS. 14A to 14C, when the boss groove 61 moves to the position of the groove end portion 67 with respect to the boss 29 (when the operation portion 73 moves to the uppermost position in the state of the lever 47), the fitting operation by the lever 47 is completed, and the male connector 22 and the female connector 23 are brought into the conductive state. That is, the main terminals 26 (see FIG. 4) of the male connector 22 and the main terminals 39 (see FIG. 5) of the female connector 23 are brought into the contact state, and the terminals 74 and 75 of the fitting detection circuit 24 (see FIG. 3) are also brought into the contact state (the state in which the fitting detection circuit 24 is in the closed state and the ON state), so that the connector 21 is in the state in which the connector fitting is completed, as shown in FIG. 14A. It is assumed that after the lock 76 passes through the boss 29 and before the groove end portion 67 moves to the position of the boss 29, the fitting detection circuit 24 is in the closed state, and thus the male connector 22 and the female connector 23 are brought into the conductive state.

<Fitting Disengagement Operation by Lever 47>

In states where the connectors are fitted as shown in FIGS. 14A to 14C, when the female connector 23 is disengaged from the male connector 22 for maintenance, for example, a following operation is performed. In other words, the operator operates as follows to release or disengage the connector fitting. An operation of the operator will be understood from the following description, whereas the operation does not require a change of hands.

Figure 15A:
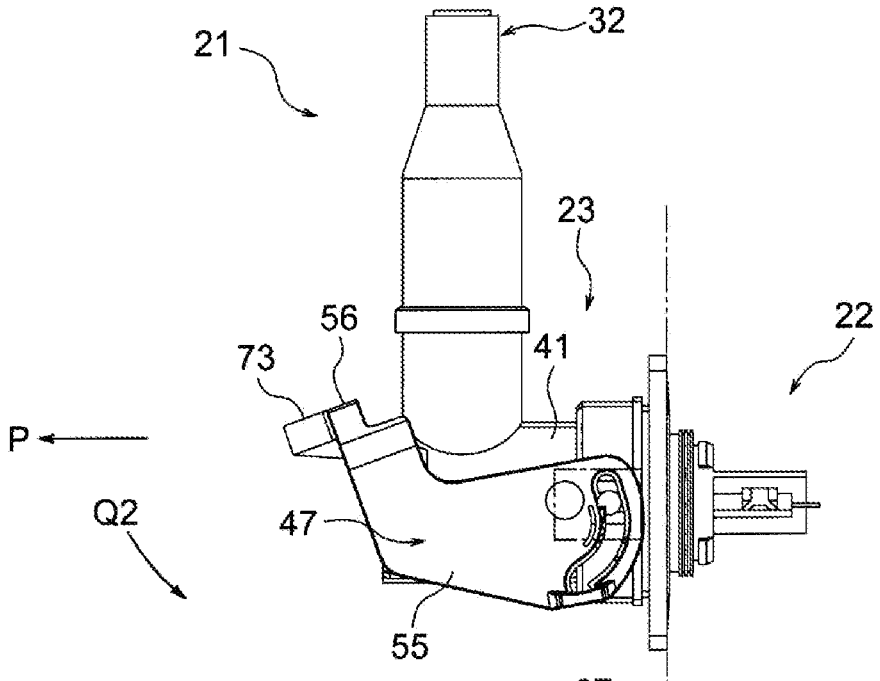
Figure 15B:
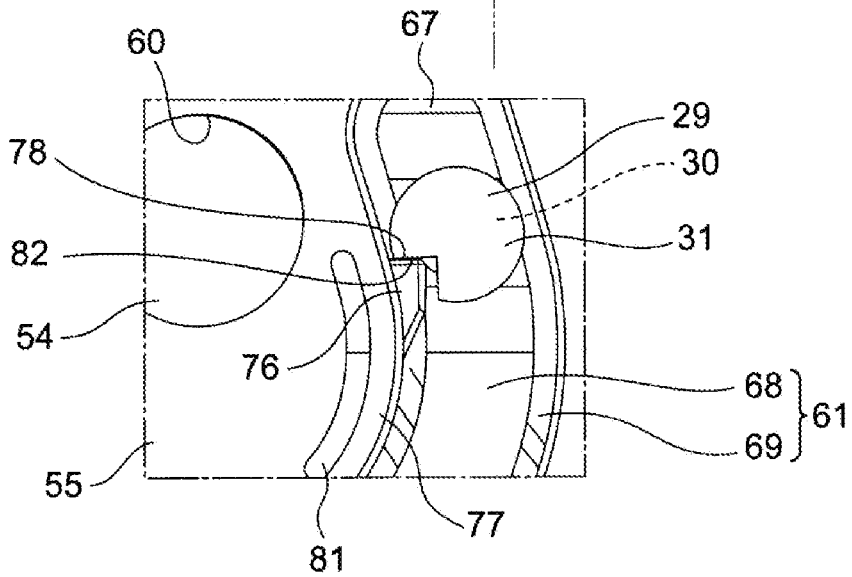
Figure 15C:
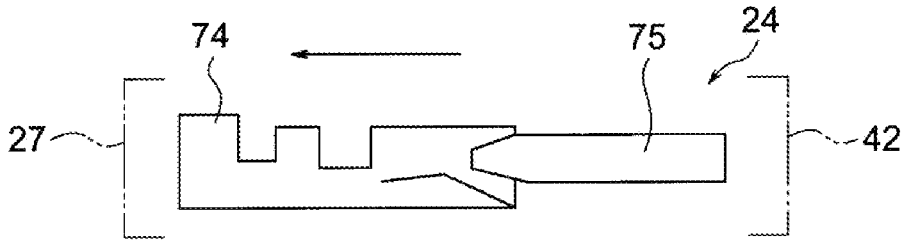
Figure 16A:
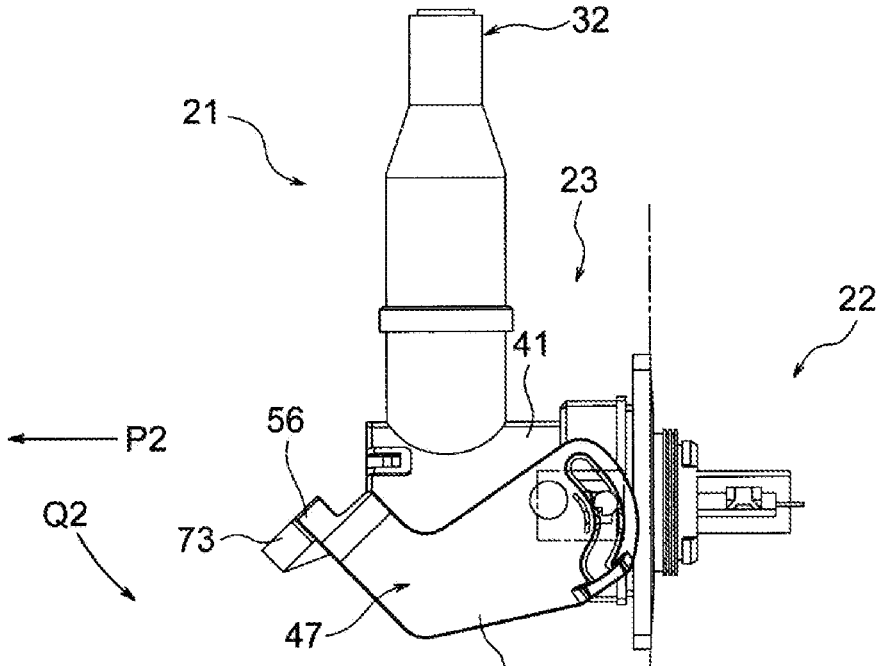
Figure 16B:
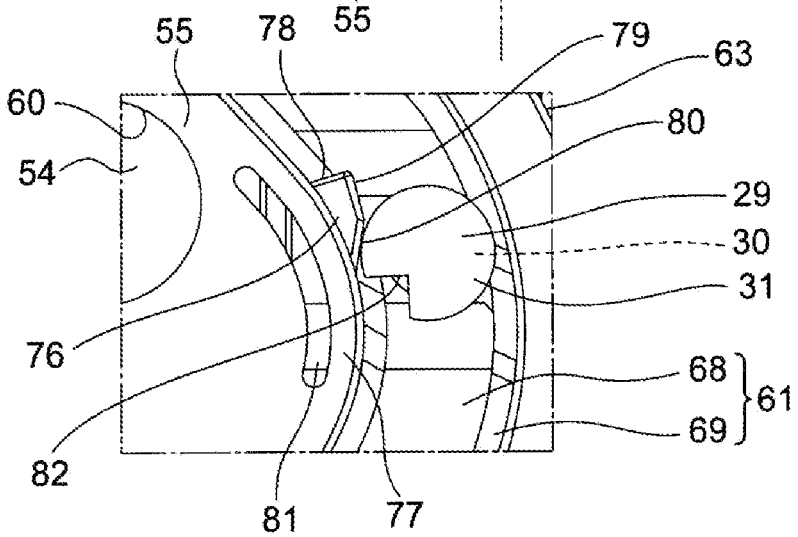
Figure 16C:
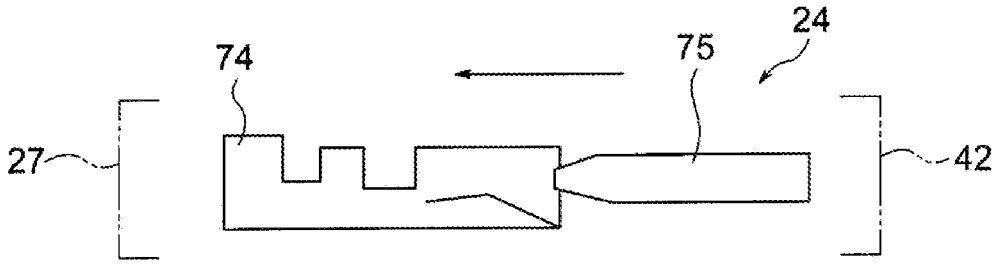

When the operator rotates the lever 47 in the direction of the arrow Q2 shown in FIG. 15A while holding the operation portion 73, the boss groove 61 moves with respect to the boss 29. Immediately after starting to move, the lock 76 of the lever 47 comes into contact with the boss 29. Specifically, the contact portion 78 of the lock 76 abuts against the cutout portion 82 of the boss 29 so as to contact. Until this contact, the female connector 23 begins to move in the fitting disengagement direction of the arrow P2 by the action of the lever 47. When the female connector 23 starts to move in the fitting disengagement direction, the main terminals 39 (see FIG. 5) of the female connector 23 slide in the direction in which the main terminals 39 are not in contact with the main terminals 26 (see FIG. 4) of the male connector 22. In addition, the terminal 74 and the terminal 75 of the fitting detection circuit 24 (see FIG. 3) also slide similarly to be in the non-contact state as shown in FIG. 15C. Since the fitting detection circuit 24 is opened (in the off state) in this state, the conduction between the male connector 22 and the female connector 23 is released.

Figure 17A:
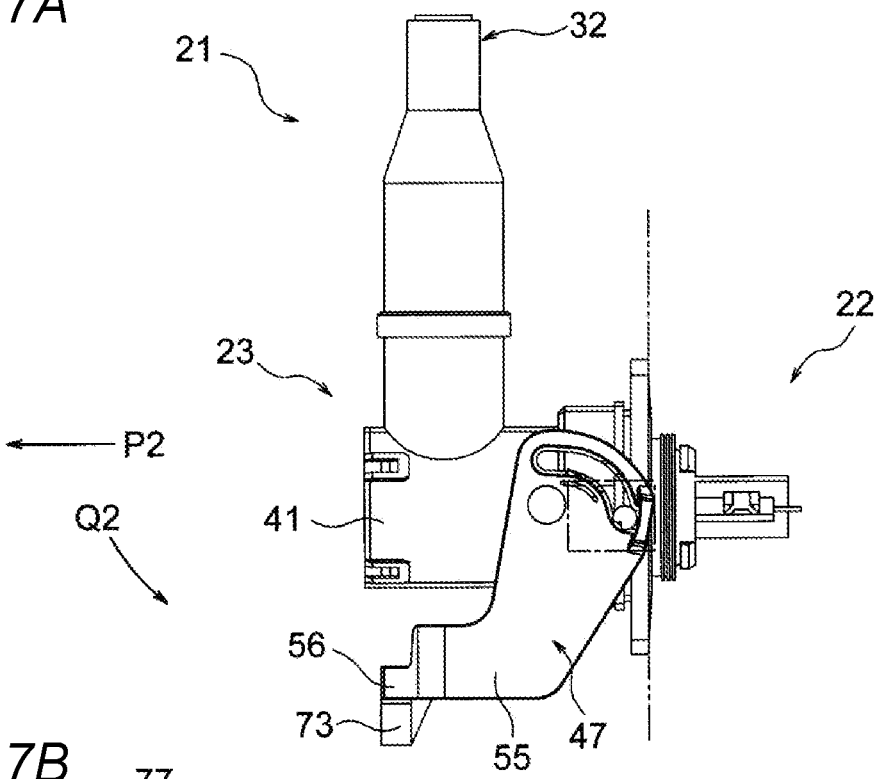
Figure 17B:
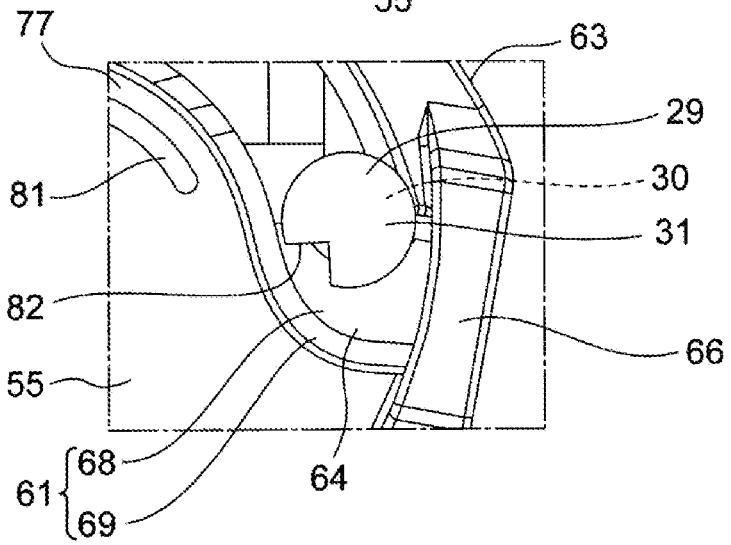
Figure 17C:
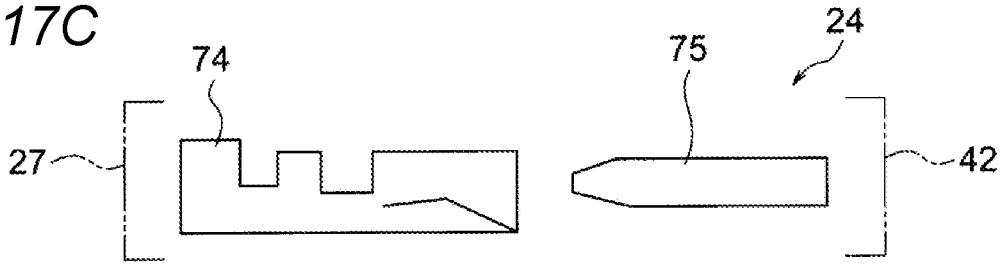

When the contact portion 78 of the lock 76 comes into contact with the cutout portion 82 of the boss 29, the rotation of the lever 47 is locked at this time. The feeling caused by the contact is transmitted to the operator. In the present embodiment, the contact feeling is momentary. This is because the contact portion 78 immediately comes off from the cutout portion 82 due to the bending of the deformation allowing portion 77, and comes into sliding contact with the side face (the outer peripheral surface which is a curved surface) of the tip end portion 31 of the boss 29. When the contact feeling is transmitted, the operator can know that the fitting detection circuit 24 is in the open state (OFF state). When the deformation allowing portion 77 bends, the locking of the rotation of the lever 47 is released. The lever 47 allows the lock 76 to pass through the boss 29 (see FIGS. 16A to 16C) with only a slight increase in the operation force by the operator. The is, the lock 76 is configured to release locking of the rotation of the lever 47 when an operation force of the fitting disengagement operation larger than a threshold is applied in a state where the lock 76 contacts the boss 29 (in other words, when a force applied to the lock 76 is larger than a threshold, the force being generated by a relative movement of the boss groove 61 and the boss 29 in response to rotation of the lever 47 in the direction of the arrow Q2 in a state where the lock 76 contacts the boss 29). When the fitting disengagement operation of the lever 47 is continued and the groove start portion 64 of the boss groove 61 moves to a position of the boss 29 as shown in FIGS. 17A to 17C, the operation by the lever 47 is completed, and the female connector 23 can be detached from the male connector 22 along the direction of the arrow P2.

In the fitting disengagement operation above by the lever 47, it is possible to take two actions including the action (first action) until the fitting detection circuit 24 is brought into the open state (OFF state) and an action after that (second action). In addition, in the fitting disengagement operation, it is possible to smoothly continue the operation without the operator changing hands in the middles of the first action and the second action.

<Effects>

As described above with reference to FIGS. 12A to 17C, according to the connector 21 of the second embodiment of the present invention, when the fitting disengagement operation is performed by the lever 47, the lock 76 of the lever 47 comes into contact with the boss 29, so that the rotation of the lever 47 can be momentarily locked by this contact. Then, by the contact between the lock 76 and the boss 29, the fitting disengagement operation can be made into two actions before and after the contact. Therefore, according to the connector 21, there is an effect that the fitting disengagement operation can be made into two actions and the operation can be performed smoothly.

In addition, it is needless to say that the present invention can be variously modified within a range not changing a scope of the present invention.

According to the embodiments as described above, it is possible to obtain the configurations and effects, for example, as described below.

A first aspect of the embodiments of the present invention provides a connector comprising: a first connector comprising a first main terminal; a second connector comprising a second main terminal and a boss having a protruding shape; and a fitting detection circuit configured to detect fitting of the first connector and the second connector, wherein the first connector further comprises a rotatable lever used for a fitting operation to the second connector and a fitting disengagement operation from the second connector, and wherein the lever comprises a lock configured to lock, when the lock contacts the boss by the fitting disengagement operation, a rotation of the lever in a state where the fitting detection circuit does not detect the fitting and also in a state where the first main terminal and the second main terminal are connected.

According to the first aspect of the embodiments of the present invention, at the time of the fitting disengagement operation, the lock formed on the lever of the first connector comes into contact with the boss formed on the second connector, so that the rotation of the lever can be locked by the contact. Details have been described with reference to drawings in the section of embodiments, and the fitting disengagement operation can be made into two actions before and after the contact by the contact between the lock and the boss.

A second aspect of the embodiments of the present invention provides the connector according to the first aspect, wherein the lock is configured to release locking of the rotation of the lever when an operation force of the fitting disengagement operation larger than a threshold is applied in a state where the lock contacts the boss.

According to the second aspect of the embodiments of the present invention, at the time of the fitting disengagement operation, it is possible to release the locking of the rotation of the lever by increasing the operation force of the fitting disengagement operation (in the section of the embodiments, a description will be made by increasing the operation force by a very small amount). Therefore, it is not necessary for an operator to change hands in order to release the locking of the rotation, and the operator can smoothly perform the operation.

A third aspect of the embodiments of the present invention provides the connector according to the second aspect, wherein the lever has a boss groove which movably engages the boss, and wherein the lock is disposed at the boss groove.

According to the third aspect of the embodiments of the present invention, it is possible to provide a better arrangement of the lock. Therefore, it is not necessary for the operator to change hands in order to release the locking of the rotation, and the operator can smoothly perform the operation.

A fourth aspect of the embodiments of the present invention provides the connector according to the third aspect, wherein the lock protrudes toward an inner side of the boss groove.

According to the fourth aspect of the embodiments of the present invention, since the lock protrudes toward the inner side of the boss groove, it is possible to easily lock the rotation of the lever or release the locking of the rotation of the lever in accordance with a movement of the boss groove with respect to the boss.

A fifth aspect of the embodiments of the present invention provides the connector according to the fourth aspect, wherein the lever comprises a deformation allowing portion that allows elastic deformation of the lever, the deformation allowing portion being provided in the lock or in the vicinity of the lock.

According to the fifth aspect of the embodiments of the present invention, since the deformation allowing portion is included in a structure, the deformation allowing portion of the lock itself or the deformation allowing portion near the lock can be elastically deformed in accordance with the movement of the boss groove with respect to the boss. The elastic deformation facilitates a displacement of the lock, and the locking of the rotation of the lever can be smoothly released.

A sixth aspect of the embodiments of the present invention provides the connector according to any one of third to fifth aspects, wherein the boss has a cutout portion at a position to be contacted by the lock.

According to the sixth aspect of the embodiments of the present invention, the lock can be brought into contact with the cutout portion formed in the boss.

According to the embodiments of the present invention, it is possible to provide an aspect in which the rotation of the lever is locked.

The invention claimed is:

1. A connector comprising:

a first connector comprising a first main terminal;

a second connector comprising a second main terminal and a boss having a protruding shape; and a fitting detection circuit configured to detect fitting of the first connector and the second connector, wherein the first connector further comprises a rotatable lever used for a fitting operation to the second connector by a rotation of the lever in a first rotation direction and a fitting disengagement operation from the second connector by a rotation of the lever in a second rotation direction opposite to the first rotation direction, wherein the lever comprises a lock configured to lock, when the lock contacts the boss by the fitting disengagement operation, a rotation of the lever in a state where the fitting detection circuit does not detect the fitting and also in a state where the first main terminal and the second main terminal are connected, wherein the lock is configured to release locking of the rotation of the lever when an operation force of the fitting disengagement operation larger than a threshold is applied by the rotation of the lever in the second rotation direction in a state where the lock contacts the boss, and wherein the lever has a boss groove that includes a step portion and an end portion, the boss groove movably engages the boss, the lock protrudes from the step portion, and the lock extends toward the end portion.

2. The connector according to claim 1, wherein the lock protrudes toward an inner side of the boss groove.

3. The connector according to claim 2, wherein the lever comprises a deformation allowing portion that allows elastic deformation of the lever, the deformation allowing portion being provided in the lock or in the vicinity of the lock.

4. The connector according to claim 3, wherein the boss has a cutout portion at a position to be contacted by the lock.

5. The connector according to claim 1, wherein the boss includes a shaft portion having a first diameter and a tip end portion, wherein the tip end portion has an outer peripheral surface that has a second diameter that is larger than the first diameter, and wherein the lock contacts the outer peripheral surface when the lock contacts the boss.

* * * * *